US011401150B2

(12) United States Patent
Leeds et al.

(10) Patent No.: US 11,401,150 B2
(45) Date of Patent: Aug. 2, 2022

(54) AUTOMATED FLUID DISPENSER SYSTEM

(71) Applicant: SOFI PAPER PRODUCTS, LLC, Miami Beach, FL (US)

(72) Inventors: Brandon Leeds, Miami Beach, FL (US); Jordan Leeds, Miami Beach, FL (US)

(73) Assignee: SOFI PAPER PRODUCTS, LLC, Miami Beach, FL (US)

( * ) Notice: Subject to any disclaimer, the term of this patent is extended or adjusted under 35 U.S.C. 154(b) by 0 days.

(21) Appl. No.: 17/081,497

(22) Filed: Oct. 27, 2020

(65) Prior Publication Data

US 2022/0127128 A1 Apr. 28, 2022

(51) Int. Cl.
*B67D 1/00* (2006.01)
*B67D 1/08* (2006.01)

(52) U.S. Cl.
CPC ..... *B67D 1/0005* (2013.01); *B67D 1/0888* (2013.01)

(58) Field of Classification Search
CPC .. B67D 1/0005; B67D 1/0007; B67D 1/0888; B67D 1/10; B67D 2210/00031; B67D 2210/00034
See application file for complete search history.

(56) References Cited

U.S. PATENT DOCUMENTS 2,228,936 A * 1/1941 Walter ..... B65D 51/1683 215/262
3,599,833 A * 8/1971 Reichenberger ..... B67D 1/10 222/23
7,395,942 B2 * 7/2008 Michalopoulos .. B65D 81/2038 141/114
8,109,301 B1 * 2/2012 Denise ..... G07F 9/023 141/360
2008/0083791 A1 * 4/2008 Allegaert ..... B65D 83/32 222/464.1
2010/0308083 A1 * 12/2010 Taylor ..... B67D 7/64 222/333
2013/0099021 A1 * 4/2013 Taylor ..... B67D 1/0831 239/24
2018/0251355 A1 * 9/2018 Alipour ..... B67B 3/24
2019/0055114 A1 * 2/2019 Bell ..... B67D 1/10
2019/0118987 A1 * 4/2019 Cannon, Jr. ..... B65D 81/2015
2019/0345018 A1 * 11/2019 Garcia ..... B67D 3/0025
2020/0087135 A1 * 3/2020 Youn ..... B01D 35/26
2021/0009402 A1 * 1/2021 Moskowitz ..... B67D 1/0888
2021/0142806 A1 * 5/2021 Kim ..... G10L 15/063

* cited by examiner

*Primary Examiner* — Donnell A Long
(74) *Attorney, Agent, or Firm* — Alston & Bird LLP

(57) ABSTRACT

Embodiments provide an automated fluid dispenser that comprises a housing, a pump subsystem, a dispenser subsystem, and a receptacle sensor. The housing defines an enclosure that covers one or more subsystems and provides an interface for attachment to a fluid reservoir. The receptacle sensor is configured to detect a fluid receptacle within a detected distance and transmit an activation signal to the pump subsystem to pump a volume of fluid. The volume of fluid is dispensed via the dispenser subsystem to a fluid receptacle. In embodiments, the volume of fluid is proportional to a detection distance or a detection time. In embodiments, the automated fluid dispenser is configured with a display device to provide one or more graphical user interface elements.

22 Claims, 16 Drawing Sheets

AUTOMATED FLUID DISPENSER SYSTEM

TECHNOLOGICAL FIELD

An example embodiment relates generally to an automated fluid dispenser system for removing fluids from fluid reservoirs.

BACKGROUND

Beverage dispensers are widely used throughout the food service industry from food trucks to wedding receptions and banquets. Traditional beverage dispensers are configured with a container that can retain a liquid for consumption by a group of individuals. Some conventional dispensers contain a large quantity of a single beverage and remain stationary while an individual can manually dispense the beverage into a cup by way of a faucet. In restaurants, or at more formal events, smaller traditional dispensers in the form of a pitcher or bottle may be placed at individual tables for customers to refill their water or other beverages as desired. Similarly, cafés may provide carafes in common areas for customers to dispense milk, cream, or water. Moreover, members of a single household may purchase and share beverages from larger multiple serving containers, for example milk cartons.

SUMMARY

Embodiments of the present disclosure are directed to an automated fluid dispenser system. The inventors have identified problems associated with traditional beverage dispensers and propose, in accordance with some embodiments, an automated dispenser that can interface with a plurality of liquid containers to overcome these identified problems. Traditional beverage dispensers are configured to function with their respective beverage container that cannot be exchanged for the containers of other dispensers or for retail beverage containers (e.g., milk cartons, plastic juice jugs, etc.). Therefore, the use of traditional beverage dispensers requires that the beverage must first be poured into the dispensers respective container prior to using the dispenser. Additionally, if any beverage is left after an event (e.g., lunch period at a restaurant, wedding reception, etc.) conventional dispensers are often too large for common refrigerators or otherwise not well suited for long term storage. This requires that the remaining beverage then be discarded or transferred into a smaller container that will fit within common refrigerators. Indeed, traditional beverage dispensers require the added processes of filling and draining proprietary containers.

Moreover, conventional dispenser systems require that each user manually manipulate a faucet (e.g., turning a lever, pressing a button, etc.) to dispense a beverage to their cup which may facilitate the spread of bacteria and viruses. For example, a first user may touch the dispenser button after coughing or sneezing and then a second user may touch the dispenser button shortly thereafter. The same is true for traditional pitcher style dispensers, such as in restaurants. Indeed, traditional beverage dispensers pose a substantially increased point of contact for the spread of bacteria and viruses and require additional disinfectant processes to be periodically performed (e.g., washing a lever or push button surface, changing the faucet, etc.). Additionally, the restaurants or hosting venues (e.g., cafeterias, banquet halls, etc.) must allocate additional employee hours to filling traditional beverage dispensers, storing or disposing of left over beverages after an event, and periodically disinfecting traditional beverage dispensers during hours of operation. It should be appreciated, in light of the present disclosure, that such aforementioned shortcomings of conventional beverage dispensers, such as hygiene and food waste concerns, would be equally applicable to households and work spaces (e.g., office break rooms, water coolers, shared coffee creamers, etc.).

The present disclosure proposes to solve at least the aforementioned problems associated with conventional beverage dispensers, for example pitchers and carafes, through at least the provision of an automated fluid dispenser system. The automated fluid dispenser may be configured with a purpose built container system, for example, a container that is built specifically to interface with the fluid dispenser and provides peripheral device features thereto. In embodiments, an automated fluid dispenser may be configured to interface with disposable container systems such as, but not limited to, milk cartons, juice gallons, water bottles, the like (e.g., other commercially available food or beverage containers utilized for the sale of food or beverage items), or combinations thereof. The automated fluid dispenser can dispense fluids, from such aforementioned container systems, to a plurality of users (e.g., restaurant customers, event patrons, household family members, etc.) with limited or no physical contact between the plurality of users and embodiments of the automated fluid dispenser.

An example embodiment comprises an automated fluid dispenser comprising a housing subsystem that, at least partially, encloses a pump subsystem, a dispenser subsystem, and sensory subsystem. The housing subsystem may be a single housing that encloses all of the automated fluid dispenser subsystems therein or each subsystem may comprise an integrated housing that is configured to interface with the integrated housing of one or more other subsystems. In some embodiments, the material(s) used to make one or more portions of the housing subsystem, or other subsystems described herein, may comprise, without limitation, natural or synthetic materials, papers, plastics (e.g., thermosets, thermoplastics, or the like), foams, fabrics, glasses, silicates, metals (e.g., steel, aluminum, etc.), metalloids, the like, or combinations thereof.

In embodiments, a plastic material used to produce a particular subsystem, or components thereof, may comprise one or more of a thermoplastic, a thermoset, polyethylene terephthalate (PETE), high-density polyethylene (HDPE), low-density polyethylene (LDPE), polypropylene (PP), polycarbonate (PC), silicone, polylactic acid (PLA), the like, or combinations thereof. In some embodiments, a particular subsystem, or components thereof, (e.g., a reusable filter element, a hose, etc.) may be repeatedly washed and reused by a consumer. For example, a pipeline hose may be produced by means of injection molding utilizing a silicone material, or the like, which can be removed from the pump subsystem, cleaned with a pipe cleaner brush and reattached to the pump subsystem. In some embodiments, a particular subsystem, or components thereof, (e.g., a paper fluid filtration element, a disposable fluid reservoir, etc.) may be configured for a one-time use. In such embodiments, one-time use components may be designed for ease of recyclability (e.g., made of compostable paper or plastic materials).

In some embodiments, the one or more materials may be at least partially treated with sealants to block the absorption of fluid into the material and thereby prevent fluid leakage. For example, seams defined by the housing subsystem can be covered or, at least partially, filled with silicone, or the like, to prevent fluid leakage and/or provide an airtight seal (e.g., to facilitate pressurized pumping). In some embodiments, sealant may be configured to prevent damage or deterioration of underlying materials or components (e.g., a paper or fabric filter element, electrical components, etc.). For example, electrical circuits (e.g., sensory circuitry, etc.) can be, at least partially, covered in polyurethane to prevent short-circuits due to moisture buildup on the electrical pathways.

Sealants may include, without limitation, one or more natural coatings, synthetic coatings, polylactic acids (PLAs), waxes (e.g., paraffin wax, beeswax, etc.), resins, epoxies, petroleum-based coatings (e.g., polyethylene, polyurethane, etc.), the like, or combinations thereof. In yet other embodiments, no sealant may be utilized, for example, in an instance that the housing subsystem provides a sufficient barrier to physical and/or chemical damage to other subsystem components. For example, the housing may be configured without seams, such as, by way of integrated injection molding processes that form the housing around one or more other subsystems as a single seamless component. In some embodiments, one or more materials may be configured with one or more channels between at least two surfaces and the space within the channels may be configured to insulate the sidewalls of a housing, a fluid reservoir (e.g., a double-wall vacuum insulated carafe, etc.), a hose, a handle, or the like. In some embodiments, the space defined by a double-walled structure (e.g., a double-wall vacuum insulated carafe, etc.) may be utilized as a housing extension (e.g., configured to house one or more of a heating element, a sensor, circuitry, a insulation material, or the like).

It will be appreciated, in light of the present disclosure, that materials (e.g., glasses, metals, plastics, foams, natural fibers, synthetic fibers, or the like) described with respect to a particular subsystem (e.g., a housing subsystem, etc.), or components thereof, may be selected for use within another subsystem (e.g., a pump subsystem, etc.). Moreover, materials may be selected and/or configured for different subsystems based on one or more of their physical characteristics including, without limitation, color, transparency, flexibility, hardness, strength, thermal properties, chemical resistance, the like, or combinations thereof. In some embodiments, the thickness of a material may be increased or decreased to proportionally increase or decrease heat transfer therethrough. For example, a material thickness may be increased to insulate one or more subsystem components (e.g., a spout, a housing, a battery, etc.), fluid reservoirs, or the like from heat transfer therethrough.

The pump subsystem is configured to pump a volume of fluid from a fluid reservoir (e.g., a milk carton, a carafe, a juice gallon, etc.) and dispense the fluid to one or more fluid receptacles (e.g., a glass, a coffee cup, etc.). The pump subsystem may comprise a pump and a pipeline and may be controlled, at least partially, by one or more circuit subsystems (e.g., a sensory subsystem communicably connected to a power subsystem by way of at least a processor). In some embodiments, a pump may comprise one or more gravity pumps, electrical pumps, mechanical pumps, dynamic pressure pumps (e.g., centrifugal, propeller, or turbine type pumps, etc.), positive displacement pumps, reciprocating pumps (e.g., piston or diaphragm type pumps, etc.), rotary pumps (e.g., gear, lobe, screw, vane, or rotary plunger type pumps, etc.), submersible pumps, the like, or combinations thereof.

In some embodiments, a pipeline comprises one or more hoses, tubes, conduits, channels, ducts, chambers, cavities, or the like by which a fluid may be at least temporarily stored and moved therethrough by way of a force generated, at least partially, by one or more pumps. For example, a pipeline may comprise two hoses configured in series with each other and connected via an electrical pump. For example, the first hose may, at least partially, extend into a fluid reservoir and defines an entrance point of the pipeline submerged within a fluid contained in the fluid reservoir. The first hose then interfaces at a second end with the pump (e.g., via a hose nipple integrated into the pump housing) thereby continuing the pipeline via the pump. The pump, for example, is configured to generate a suction force in the first hose, pulling fluid through the first hose and, at least a portion of the pump and then the pump generates a pushing force in at least the second hose forcing the fluid through the second hose to an exit point of the pipeline. The second hose may be connected at a first end to the pump while the second hose also defines the pipeline exit point at a second end.

The pipeline components (e.g., tubes, hoses, portions of pumps, etc.) may be configured in a single series of components defining a continuous pathway through which a fluid enters as a first point (i.e., an entrance) and is expelled via a second point (i.e., an exit). In embodiments, the pipeline components may be configured, at least partially, to define a plurality of parallel pathways for fluid to flow. For example, a pipeline may be configured with three hoses and a pump. For example, the first hose may define an entrance point of the pipeline at a first end and at a second end interface with the pump. The pump may define a divergent point of the pipeline and force the fluid into either a second hose or a third hose each leading to a respective exit point of the pipeline.

In some embodiments, the pump subsystem may comprise an intake pipeline and an output pipeline. The intake pipeline may be configured to receive air (e.g., via fluid reservoir vent opening(s), housing opening(s), etc.) from the environment external to the housing and/or fluid reservoir (e.g., a kitchen, a dining room, etc.) and force the air into the fluid reservoir. The air forced into the fluid reservoir, via the intake pipeline, causes the interior of the fluid reservoir to become pressurized. The output pipeline may be configured to receive fluid from the pressurized fluid reservoir and convey the fluid through at least the housing to the dispenser subsystem. For example, the pump subsystem may pump air into the fluid reservoir via the intake pipeline until a partial internal fluid reservoir pressure is reached, for example, 5 pound per square inch (PSI) measured via a pressure sensor. In some such embodiments, the pump subsystem may comprise one or more pumps associated with the intake pipeline and the output pipeline. For example, a first pump may be configured to pressurize the fluid reservoir via the intake pipeline and a second pump may be configured to pump a volume of fluid out of the fluid reservoir.

In some embodiments, a pump may be configured to pressurize the fluid reservoir via the intake pipeline and a valve may be configured to regulate the flow of fluid out of the fluid reservoir via the output pipeline. For example, the pump associated with the intake pipeline may pressurize the fluid reservoir and then a receptacle sensor may send a signal to a valve to cause the valve to open (e.g., for a predefined time period, until the receptacle sensor sends another signal, etc.) thereby dispensing a volume of fluid. In some embodiments, a pressure sensor may be associated with one or more of a pump, a fluid reservoir, or the like. For example, the pump associated with the intake pipeline may be configured with an internal pressure sensor and upon measuring a predefined pressure during a pumping operation/cycle, the pump will stop pumping. In some embodiments, if the measured internal pressure drops below a predefined pressure then the pump associated with the intake pipeline may initiate another pumping operation/cycle.

It will be appreciated, in light of the present disclosure, that a plurality of hoses and one or more pumps may be configured in parallel with each other to dispense a fluid to a plurality of users at once. Example embodiments, may comprise a plurality of fluid reservoirs each containing different fluids dispensable via independent pump subsystems (e.g., separate pumps, pipelines, etc.). In embodiments, the pump subsystem may be configured with pump circuitry configured to regulate one or more pumps (e.g., a volume of fluid to pump, a pumping time, a pump pressure, a motor speed, etc.) and interface with one or more other circuit components (e.g., sensor circuits, control circuits, processors, power circuits, or the like). For example a sensor circuit may receive a signal via one or more sensors (e.g., a proximity sensor, etc.) and in response the sensor circuit provides an activation signal to a pump circuit which then, as a result, starts a pump. The pump circuit may further communicate, for example via at least a Metal Oxide Semiconductor Field Effect Transistor (MOSFET), with a power subsystem to provide sufficient electrical current/voltage to an electrical pump. In some embodiments, a pipeline, or the like, may comprise a flexible silicone hose, a rigid stainless steel tube, a channel defined by a housing (e.g., an internal channel or chamber within a pump, etc.), a glass or transparent plastic straw, a mesh fabric hose, a plurality of pores defined by a filter element or filter material (e.g., activated charcoal, etc.), the like, or combinations thereof.

The dispenser subsystem may comprise a spout and a nozzle. In some embodiments, the pipeline of the pump subsystem may at least partially define, or otherwise be integrated with, the spout or nozzle of the dispenser subsystem. In other embodiments, the pipeline of the pump subsystem may be configured to interface with one or more additional pipelines defined by the dispenser subsystem. For example, a silicone hose extending from the pump at a first end (i.e., a portion of a pump subsystem pipeline) may interface with the dispenser subsystem, at a second end, via a hose nipple defined by a dispenser subsystem housing. In some embodiments, the dispenser subsystem housing may define, at least partially, the spout. For example, the dispenser subsystem housing can define a water tight cavity that receives a fluid from the pump subsystem via a hose nipple interface at a first end and allows the fluid to flow through the housing to a second end configured with a nozzle defining an opening through which the fluid is dispensed.

In some embodiments, fluid is forced to flow through the spout (e.g., a dispenser subsystem cavity, etc.) via a force generated, at least partially, by the pump subsystem. In some embodiments, fluid is forced to flow through the spout (e.g., a dispenser subsystem cavity, etc.) due to a gravitational force. For example, the spout may be configured with a first end (e.g., a fluid entrance point) that is, at least slightly, elevated above a second end (e.g., a fluid exit point) and is configured with a substantially smooth and linear pathway therebetween (e.g., a silicone hose connecting the first end and the second end). In some embodiments, the dispenser subsystem can be configured with a pump similar to one or more pumps described with respect to the pump subsystem to convey fluid through the dispenser subsystem. In such embodiments, a pump configured as a component of the dispenser subsystem may be configured to function as a valve. For example, a rotary pump may be configured (e.g., with a pump control circuit, a mechanical switch accessible to a user, etc.) to lock its rotor into one or more positions to prevent fluid to flow through the pump, thus functioning as a valve for the dispenser subsystem. In some embodiments, the dispenser subsystem may be configured with one or more valves. A valve may comprise one or more ball valves, check valve, butterfly valves, mechanical valves, electrical valves, gate valves, globe valves, the like, or combinations thereof.

While example embodiments illustrated herein generally provide a pump subsystem, embodiments may include a gravity-fed fluid transport subsystem. For example, if a fluid reservoir is disposed above a dispenser subsystem, a pumping action may not be necessary, such that the pump subsystem may be omitted in favor of a gravity-fed fluid transport subsystem that includes a pipeline configured to receive a fluid from the fluid reservoir and convey the fluid between a first opening of the fluid transport subsystem and a second opening of the fluid transport subsystem. The dispenser subsystem may receive the fluid and dispense the fluid through a fluid exit as detailed with respect to the embodiments that include a pump subsystem.

In some embodiments, the nozzle of the dispenser subsystem may be a valve, a funnel, a sprayer, a diffuser, a mixing chamber (e.g., for combining two or more fluids from a plurality of pump subsystems, etc.), a filter element, a hole defined by the dispenser subsystem housing, a hole defined by a silicone hose, the like, or combinations thereof. For example, a butterfly valve may be screwed onto an opening defined by the spout at a first end of the valve. The second end of the valve may be configured with a filter element removably attached thereto to prevent any contaminants from entering via the valve when the valve is in an open position. In some embodiments, a filter element may comprise one or more mesh screens (e.g., stainless steel mesh, etc.), paper filters, natural materials, synthetic materials, filter cartridges (e.g., string wound, pleated, resin bonded, spun polypropylene, etc.), carbon blocks, activated charcoal, ceramics, magnetics, the like, or combinations thereof. In some embodiments, the filter element may be permanently attached to the nozzle, such as by mechanical attachment means (e.g., welding, etc.) and/or chemical attachment means (e.g., gluing, etc.). In some embodiments, the filter element may be integrated into the nozzle. For example, the filter element may be a mesh screen that is formed with the nozzle from a single sheet metal flat/blank during a stamping operation.

In some embodiments, the nozzle may define one or more of a frustoconical shape, a semi-spherical shape, a circular shape, or the like. In some embodiments, the nozzle may be re-positionable (e.g., attached to a modular hose, a gooseneck hose, or the like extending from or integrated into the spout). In some such embodiments, the spout and nozzle may comprise a flexible and/or re-positionable hose assembly. For example, the spout may comprise a C-pipe attached at a first end to housing (e.g., a pump subsystem housing, etc.) via swivel joint and attached to the nozzle via a second end via a ball joint. In such an embodiment, the spout and nozzle would have some degree of position ability. It will be appreciated, in light of the present disclosure, that a spout and or nozzle could be positioned to provide proper line of sight for a sensor (e.g., a receptacle sensor, etc.), and/or to provide clearance between large or abnormally shaped fluid receptacles (e.g., insulated to-go cups, etc.) and the fluid reservoir or subsystem components.

The sensory subsystem may comprise one or more sensors and sensor circuits configured to detect the presence of one or more environmental conditions. The one or more environmental conditions may be internal or external relative to an automated fluid dispenser. For example, a proximity sensor may be attached to the underside of the dispenser subsystem housing to detect the presence of a coffee mug and upon detection of a coffee mug the sensor provides a signal to a sensor circuit to indicate that a particular volume of fluid should be dispensed. In other embodiments, a motion sensor, or the like, may be placed on the top of a pump system housing so that a user may wave their hand over the motion sensor to turn-on/off the automated fluid dispenser (e.g., turn-on/off an display, turn-on/off the receptacle sensor, activate a heating or cooling subsystem, etc.). In some embodiments, the sensory subsystem may comprise a temperature sensor for monitoring the temperature of a fluid contained within a fluid reservoir. For example, a thermistor may be attached to a pump subsystem pipeline portion which extends into the fluid reservoir to monitor the fluid temperature and if the fluid temperature is detected to have exceeded a temperature threshold (e.g., rise above or fall below a predefined temperature value, etc.) the sensory system causes a display to output a notification to a user (e.g., a blinking red light to indicate to a waiter to replace the carafe). In some embodiments, a sensor may comprise one or more proximity sensors, light sensors, touch sensors, pressure sensors, temperature sensors, switches, buttons, sliders, fill sensors, volume sensors, the like, or combinations thereof.

Another example embodiment may further comprise one or more of a user interface subsystem, a power subsystem, a heating subsystem, a cooling subsystem, the like, or combinations thereof.

The user interface subsystem may comprise one or more of a touch screen display configured with graphical user interface elements, push buttons, toggle buttons, switches, sensors, light emitting diodes, sound emitting diodes, buzzers, haptic feedback devices, stickers, engravings, printed letters/numbers/symbols (e.g., on a housing in proximity to an associated light or display screen), sensors (e.g., motion sensors or the like), the like, or combinations thereof. In embodiments, the graphical user interface elements may be configured to display a condition to a user (e.g., a temperature of a fluid, a time of day, etc.) or receive user interface interactions (e.g., a user touches a graphical user interface element that turns-on/off the power subsystem, causes a volume of liquid to be dispensed, etc.).

The power subsystem may comprise one or more of a battery, a power cord, a universal serial bus (USB) port, a USB charging cable, a power converter, a fuse, a MOSFET, a switch, an operational amplifier, a power transformer, a solar cell, the like, or combinations thereof. The power subsystem can be configured to regulate power distribution to one or more other subsystems, for example, by increasing or decreasing voltage and/or current thereto, transforming a current (e.g., amplitude, phase, frequency, etc.), or the like.

The cooling subsystem may comprise a registration system configured for lowering the internal temperature of one or more fluid reservoirs. The cooling system may comprise an evaporating coil, an evaporator fan, an expansion valve, a thermostat switch, one or more sensors (e.g., a sensing bulb, etc.), a suction line, a liquid line, a condenser coil, a motor compressor, a condenser fan, the like, or combinations thereof. In some embodiments, the cooling system may comprise one or more compartments within a fluid reservoir filled with ice, dry ice (i.e. solid carbon dioxide), coolant, the like or combinations thereof.

The heating subsystem may comprise a heater configured to increase the internal temperature of one or more fluid reservoirs. The heating subsystem may comprise an electrical heating element, a reverse refrigeration system, a chemical fueled flame (e.g., tea candle, chafing dish fuel canister, propane canister, etc.), the like, or combinations thereof. In some embodiments, the heating subsystem may be configured to raise a liquid to boiling and/or maintain an internal temperature of a fluid reservoir above a predefined temperature threshold. In some embodiments, the heating or cooling subsystems may comprise one or more insulation materials (e.g., cork, spray foam, foam board, fiberglass, non-fiberglass, aluminum foil, cellulose, the like, or combinations thereof) to maintain an internal fluid reservoir temperature, or to shield one or more temperature sensitive subsystems, or components thereof, from unfavorable temperatures.

According to an aspect of the present disclosure, there is provided an automated fluid dispenser, comprising a housing, a pump subsystem, a dispenser subsystem and a receptacle sensor. The housing comprises one or more materials and the housing defines a body comprising a top surface, a sidewall, and a bottom surface, the housing is configured to attach to a fluid reservoir via a fluid reservoir interface. The pump subsystem that is at least partially enclosed by the housing, the pump subsystem comprises a pump and a pipeline, the pipeline is configured to receive a fluid from the fluid reservoir and convey the fluid via the pump between a first opening of the pump subsystem and a second opening of the pump subsystem. The dispenser subsystem that is at least partially enclosed by the housing and extends from one or more of the top surface or the sidewall of the body, the dispenser subsystem comprises a spout and a nozzle, the spout is attached to the body at a first end of the spout and to the nozzle at a second end of the spout, the spout is configured to receive the fluid from the pump subsystem and convey the fluid to the nozzle, the nozzle defines a fluid exit opening through which the fluid exits the dispenser subsystem. The receptacle sensor that is at least partially enclosed by the housing, the receptacle sensor is configured to detect, within a predefined distance, a distance between the receptacle sensor and a fluid receptacle that is within the predefined distance and transmit a signal, to at least the pump subsystem, causing the pump subsystem to pump a volume of fluid.

In some embodiments, the volume of fluid is proportional to a detected distance between the receptacle sensor and the fluid receptacle. For example, if a fluid receptacle is determined to be, approximately, 4 inches away from the receptacle sensor then 4 ounces of milk will be dispensed (i.e., 1 ounce for every 1 unit of distance detected by the sensor).

In some embodiments, the volume of fluid is proportional to a period of time that the fluid receptacle is detected by the receptacle sensor. For example, if a fluid receptacle is determined to be within a range of 1 to 5 inches of the receptacle sensor for eight seconds then 4 ounces of milk will be dispensed (i.e., 1 ounce for every two seconds the receptacle is detected by the sensor).

In some embodiments, the receptacle sensor is configured to detect a first distance between the receptacle sensor and the fluid receptacle and cause the pump subsystem to pump a first volume of fluid. In some embodiments, the receptacle sensor is configured to detect a second distance between the receptacle sensor and the fluid receptacle and cause the pump subsystem to pump a second volume of fluid. In some embodiments, the receptacle sensor is configured to detect a plurality of third distances between the receptacle sensor and the fluid receptacle and cause the pump subsystem to pump a respective volume of fluid associated with each of the plurality of third distances. For example, if a fluid receptacle is determined to be, approximately, between 0 to 3 centimeters away from the receptacle sensor then 1 ounce of milk will be dispensed, while if the fluid receptacle is determined to be, approximately, between 3 to 6 centimeters away from the receptacle sensor then 2 ounces of milk will be dispensed.

In some embodiments, the automated fluid dispenser further comprises a user interface subsystem, the user interface subsystem comprises one or more user interface elements, the user interface elements comprise one or more of a push button, a toggle button, a switch, a slider switch, a light sensor, a motion sensor, a pressure sensor, a light emitting diode (LED), a microphone, or a speaker.

In some embodiments, the user interface subsystem comprises a touch screen display and one or more graphical user interface elements.

In some embodiments, the touch screen display is configured to render one or more of a maximum capacity, a fluid level, an alpha-numeric character, a power level, a date, a time of day, a countdown timer, or a temperature.

In some embodiments, the automated fluid dispenser further comprises a power subsystem that is at least partially enclosed by the housing, the power subsystem comprises one or more of a power regulation circuit, a battery, an electrical outlet interface, a universal serial bus interface, a charging circuit, or a photovoltaic cell.

In some embodiments, the housing comprises a handle extending from one or more surfaces defined by the housing.

In some embodiments, the pump is one or more of a dynamic pump, positive displacement pump, centrifugal pump, rotary pump, reciprocating pump, internal/external gear pump, slide/rotary vane pump, piston pump, plunger pump, screw pump, or diaphragm pump.

In some embodiments, the pipeline is one or more of a pipe, a tube, or a hose, and comprises one or more of a rigid or flexible metal, plastic, fabric, composite, ceramic, or glass material.

In some embodiments, the pipeline comprises a flexible hose that is attached, at a first end of the flexible hose, to the bottom surface of the housing by way of a hose nipple and is attached, at a second end of the flexible hose, to a frustum sinker, the frustum sinker defines a pipeline intake opening that extends from a first surface of the frustum sinker to a second surface of the frustum sinker.

In some embodiments, the receptacle sensor comprises one or more of a light emitting diode, a motion sensor, a proximity sensor, a pressure sensor, a camera, or a limit switch.

In some embodiments, the housing comprises one or more of a housing opening, the housing opening is configured to receive a battery, receive a universal serial bus (USB) cable, release pressure from the pump subsystem, release pressure from the fluid reservoir, release moisture from the pump subsystem, or release moisture from the fluid reservoir.

In some embodiments, the housing opening is defined by a pressure release valve and the housing opening is at least partially covered by a filter, mesh, or screen.

In some embodiments, the fluid reservoir interface is defined by one or more first threaded surfaces of the housing configured to interlock with one or more second threaded surfaces of the fluid reservoir.

In some embodiments, the fluid reservoir interface is defined by one or more seals, and at least the one or more seals are configured to maintain a negative pressure environment within the fluid reservoir.

In some embodiments, the fluid reservoir is a plurality of fluid reservoirs, and wherein the fluid reservoir is thermally insulated.

In some embodiments, the housing is configured to removably attach to the fluid reservoir via the fluid reservoir interface. In some embodiments, the housing is configured to permanently attach to the fluid reservoir via the fluid reservoir interface. In some embodiments, the fluid reservoir interface may comprise one or more of a latch, a threaded surface, a screw, a bolt, a nut, an adhesive, a weld, a chemical attachment means, a mechanical attachment means, or the like. In some embodiments, the housing is configured with an integrated fluid reservoir, wherein the integrated fluid reservoir comprises at least a portion of the housing. In some embodiments, the fluid reservoir interface comprises a seamless transition between the sidewall of the housing and the sidewall of the fluid reservoir.

According to an aspect of the present disclosure, there is provided a method for extracting and dispensing fluids with an automated fluid dispenser. The method comprises attaching the automated fluid dispenser to a fluid reservoir via a fluid reservoir interface.

In embodiments, the method further comprises receiving an activation signal via a user interface subsystem, the activation signal causing a power subsystem to at least supply electrical power to a pump and a receptacle sensor.

In embodiments, the method further comprises receiving a receptacle sensor indication via the receptacle sensor, the receptacle sensor indication causes the pump to at least initiate a pump cycle.

In embodiments, the method further comprises pumping a volume of fluid via a pump subsystem comprising the pump and a pipeline, the pipeline configured to receive the volume of fluid from the fluid reservoir and convey the volume of fluid, via the pump, between a first opening of the pump subsystem and a second opening of the pump subsystem.

In embodiments, the method further comprises transferring the volume of fluid from the pump subsystem to a dispenser subsystem comprising a spout and a nozzle, the volume of fluid is received by the spout via the second opening of the pump subsystem and flows to the nozzle, the nozzle defines a fluid exit opening through which the volume of fluid exits the dispenser subsystem.

In embodiments, the method further comprises releasing the volume of fluid via the nozzle.

In some embodiments, the method further comprises opening one or more valves that define an interface between one or more subsystems. In some embodiments, the method further comprises closing one or more valves that define an interface between one or more subsystems. In some embodiments, the method further comprises locking, in an open, closed, or intermediate position, one or more valves that define an interface between one or more subsystems.

In some embodiments, the method further comprises measuring a temperature, via at least a temperature sensor, of a fluid contained within a fluid reservoir.

In some embodiments, the method further comprises measuring a volume, via at least a fill sensor, of a fluid contained within a fluid reservoir.

In some embodiments, the method further comprises displaying one or more of a volume capacity (e.g., a maximum capacity that can be stored within a fluid reservoir, a current capacity that is less than the maximum capacity held by a fluid reservoir, etc.), a temperature, a date, a time, a volume to be dispensed, or a message (e.g., a temperature warning, a re-fill required message, a notification to clean a filter element, etc.) via a display device. In some embodiments, the display device may be a liquid crystal display configured with or without a touchscreen.

In some embodiments, the method further comprises removing one or more filter elements, inspecting one or more filter elements, cleaning one or more filter elements, replacing the one or more cleaned filter elements, and/or replacing one or more used filter elements with one or more new filter elements. In some embodiments, the one or more filter elements may be disposable one-time use filter elements. In other embodiments, the one or more filter elements may be reusable filter elements that can be cleaned and replaced by a user (e.g., a stainless steel mesh filter that can be run through a dishwasher cleaning cycle, etc.).

In some embodiments, the method further comprises attaching a cleaning device (e.g., a cleaning fluid reservoir, etc.) to the automated fluid dispenser. In some embodiments, the method further comprises filling a fluid reservoir with a detergent, soap, or other cleaning agent and running a cleaning program code installed on one or more memory devices (e.g., non-transitory computer readable storage medium, etc.) of the automated fluid dispenser, wherein the cleaning program code causes the pump system of the automated fluid dispenser to continuously pump the detergent, soap, or other cleaning agent through the pipeline at a higher pressure and/or faster rate of speed than is utilized for dispensing beverages. In some embodiments, the cleaning operations may be associated with a particular cleaning fluid reservoir (e.g., a fluid reservoir configured to hold a predefined cleaning capacity and operate at higher pressures/temperatures and/or with certain cleaning agents).

According to an aspect of the present disclosure, there is provided a non-transitory computer readable storage medium comprising instructions for extracting and dispensing fluids, that when executed by a processor, cause an automated fluid dispenser comprising at least one processor and at least one memory to receive an activation signal via a user interface subsystem comprising a touch screen display, the activation signal causing a power subsystem to at least supply electrical power to a pump and a receptacle sensor. The non-transitory computer readable storage medium comprising instructions may be further configured, upon execution, to at least receive a receptacle sensor indication via the receptacle sensor, the receptacle sensor indication causes the pump to at least initiate a pump cycle defining at least a cycle runtime that is proportional to one or more receptacle sensor indication attributes. The non-transitory computer readable storage medium comprising instructions may be further configured, upon execution, to at least display, via the touch screen display, one or more graphical user interface elements defining at least a time of day, a fluid reservoir capacity level, an internal fluid reservoir temperature, a power subsystem capacity level, and a fluid name. The non-transitory computer readable storage medium comprising instructions may be further configured, upon execution, to at least dynamically display, via the touch screen display, in response to at least the receptacle sensor indication, a volume of fluid defined by the pump cycle.

In some embodiments, the non-transitory computer readable storage medium comprising instructions may be further configured, upon execution, to at least cause the automated fluid dispenser to run cleaning operations, wherein the cleaning operations include at least causing the pump system of the automated fluid dispenser to continuously pump a detergent, soap, or other cleaning agent through a pipeline at a higher pressure and/or faster rate of speed than is utilized for dispensing beverages. Stop the cleaning operations once a predefined volume capacity associated with the fluid reservoir has been detected (e.g., the maximum volume capacity of the fluid reservoir has been detected as being pumping through the pumping system during the cleaning operations). In some embodiments, the cleaning operations may be associated with a particular cleaning fluid reservoir (e.g., a fluid reservoir configured to hold a predefined cleaning capacity and operate at higher pressures/temperatures and/or with certain cleaning agents).

Various other aspects are also described in the following detailed description and in the attached claims.

BRIEF DESCRIPTION OF THE DRAWINGS

Figure 1:
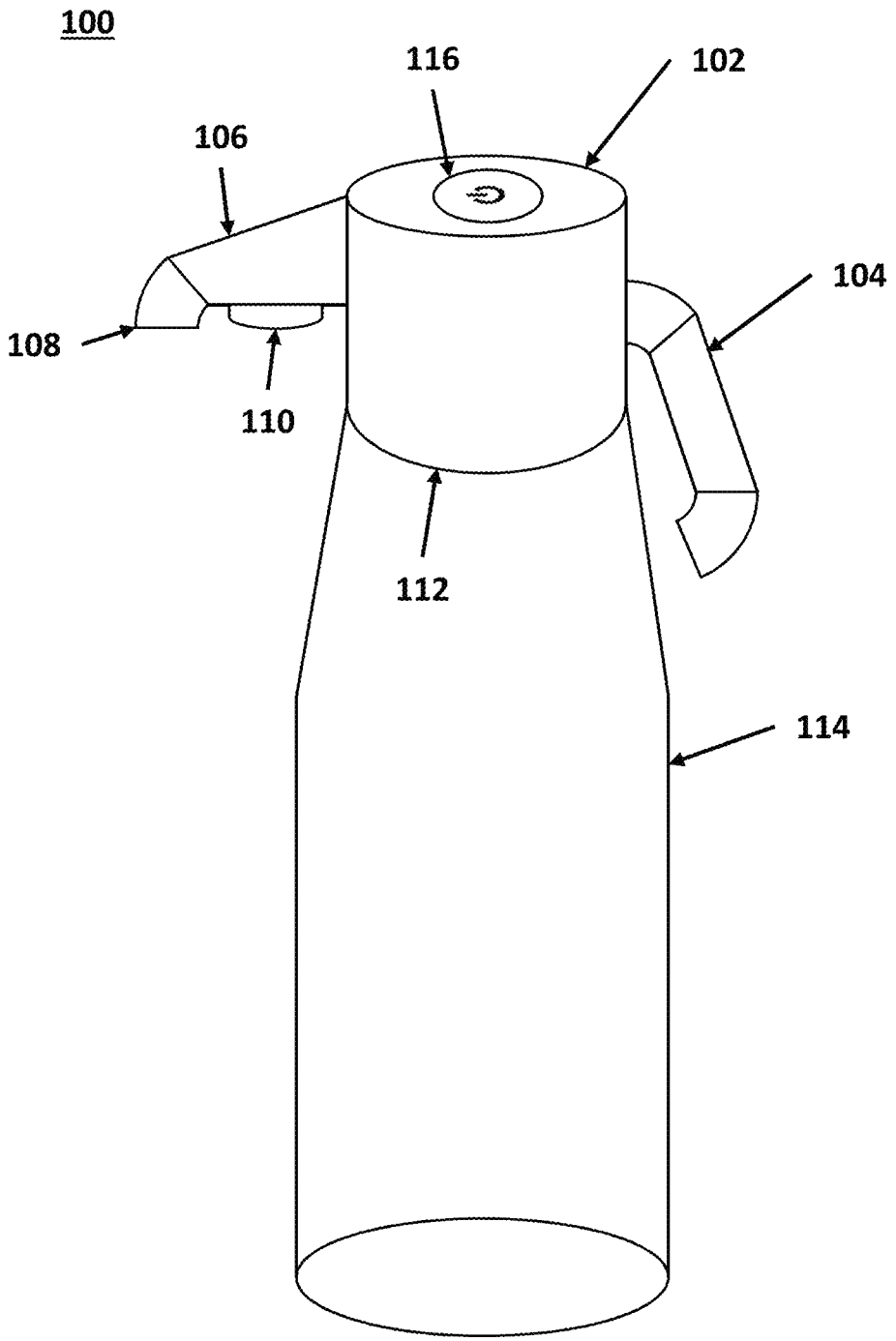
Figure 2:
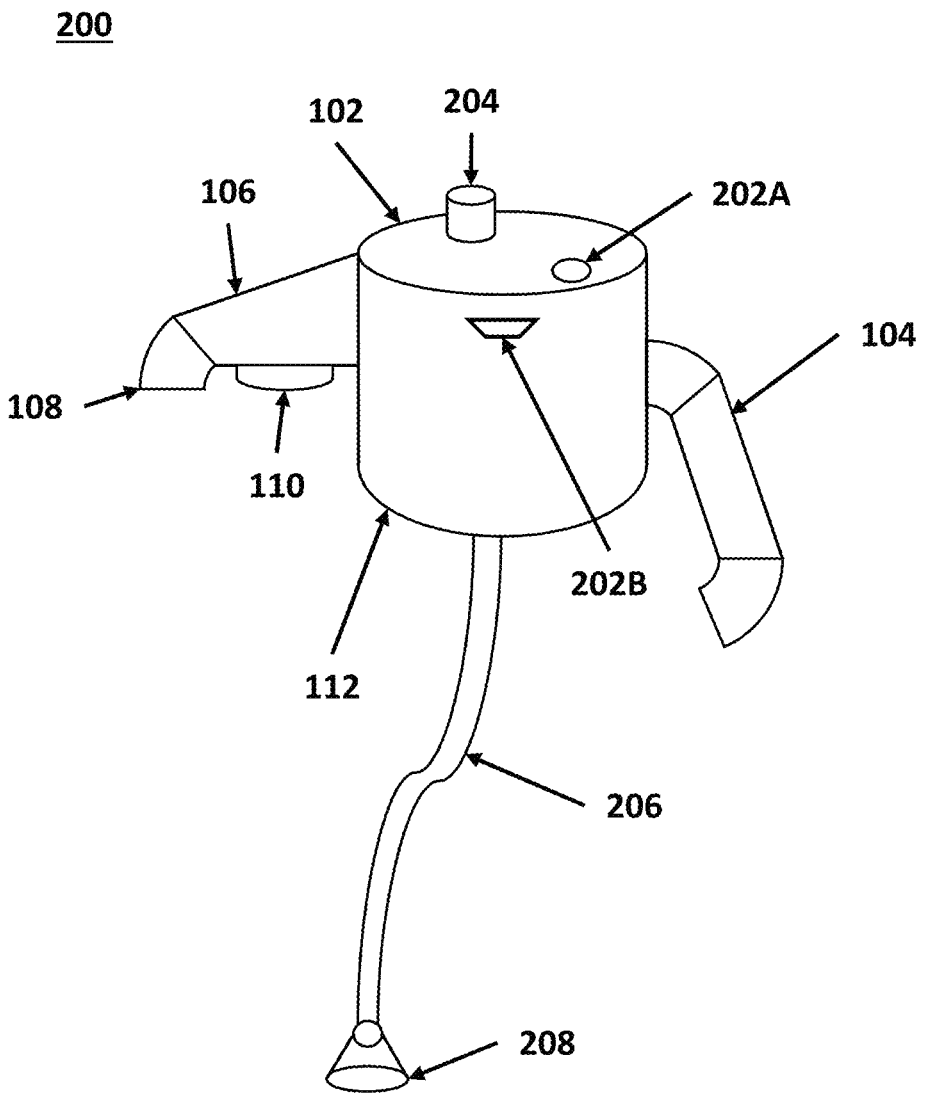
Figure 3:
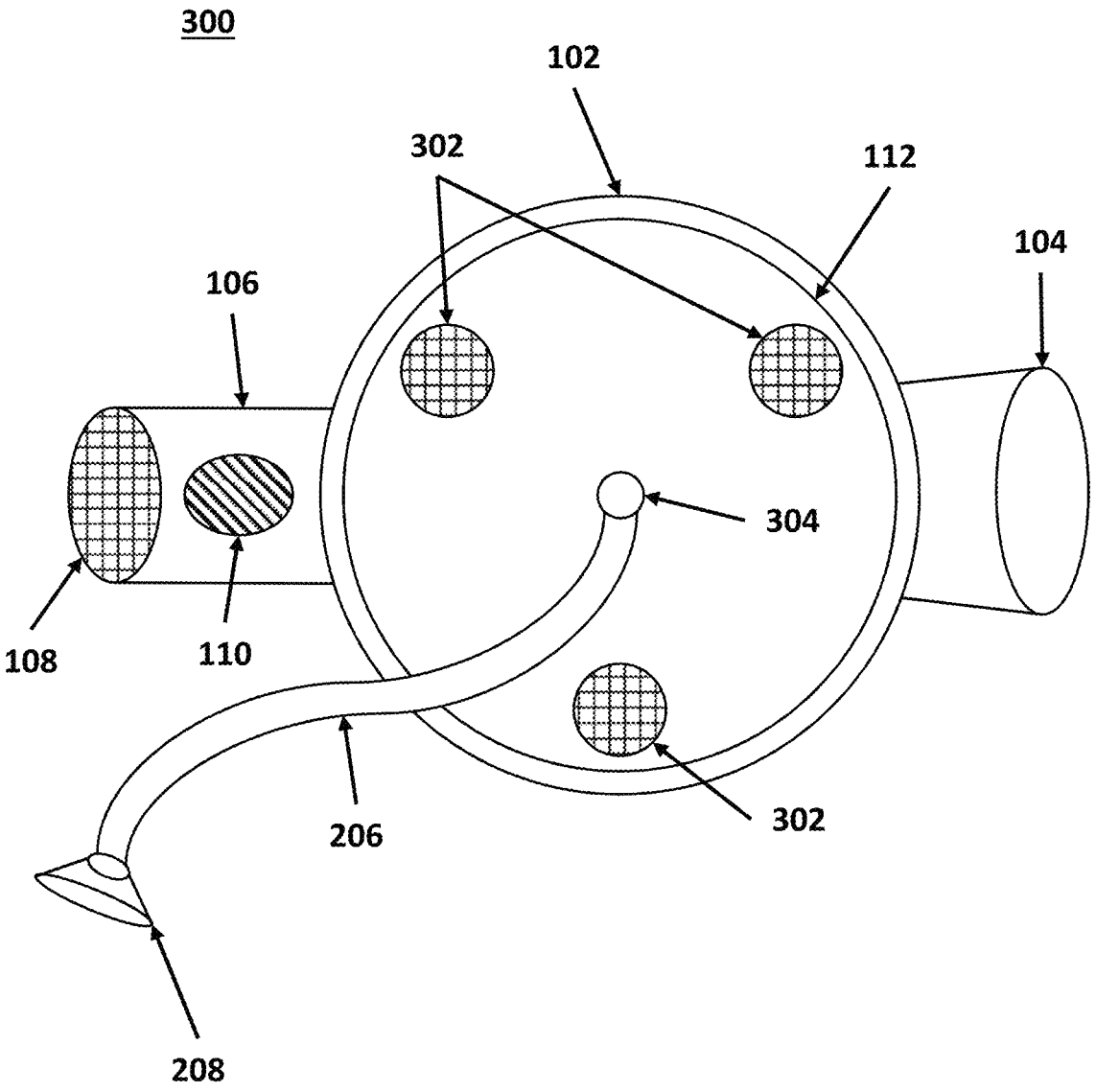
Figure 4:
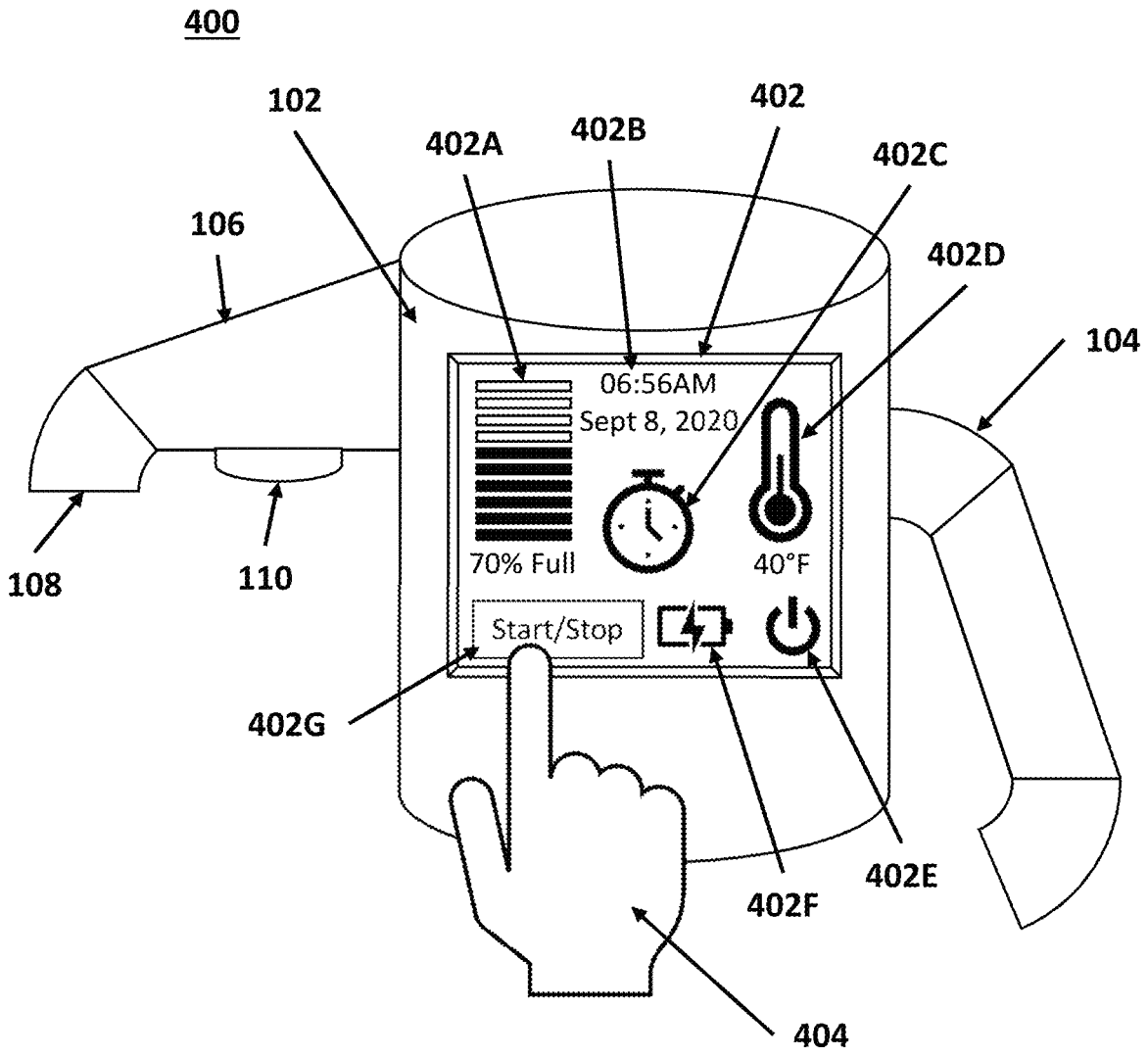
Figure 5:
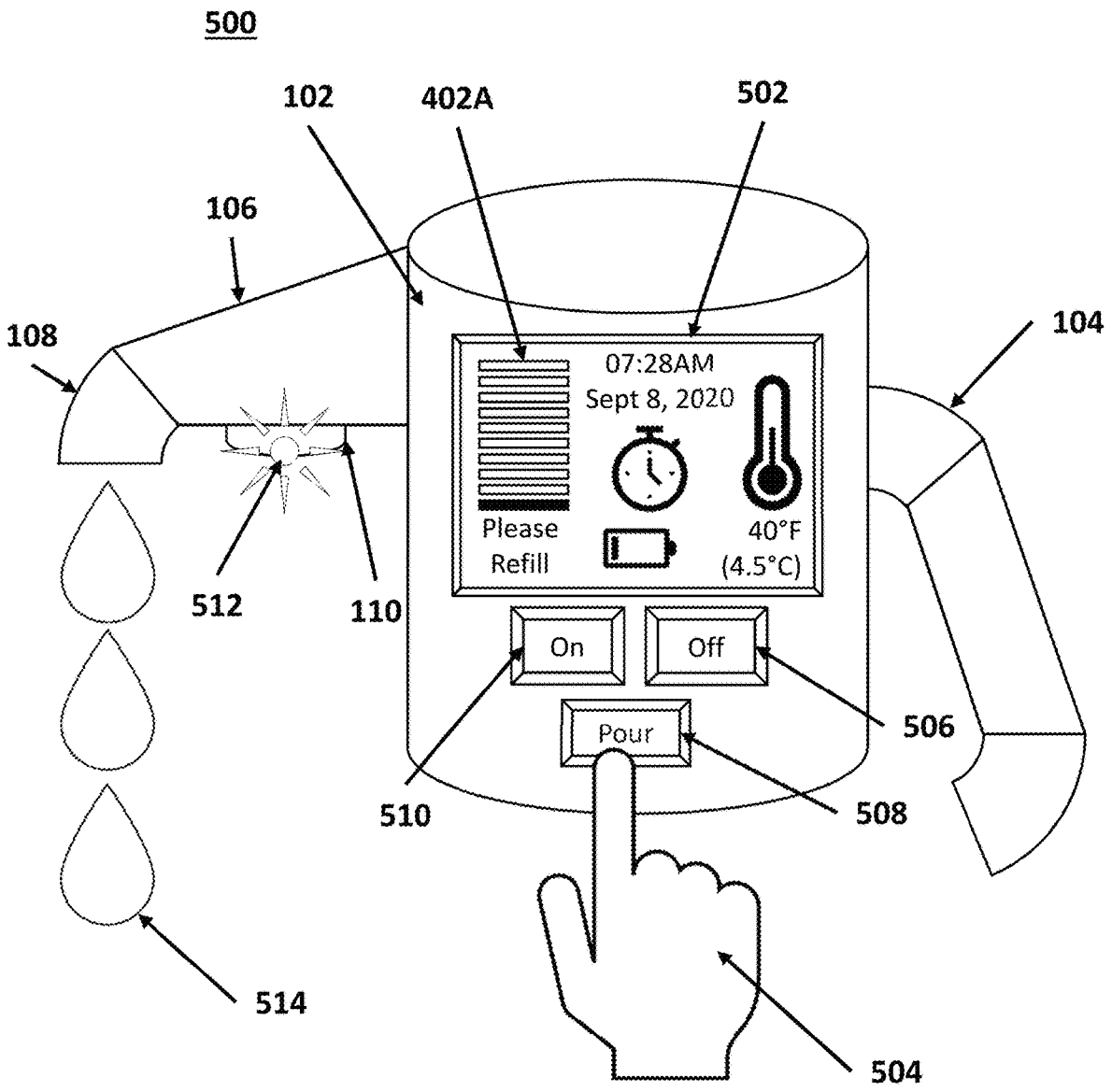
Figure 6:
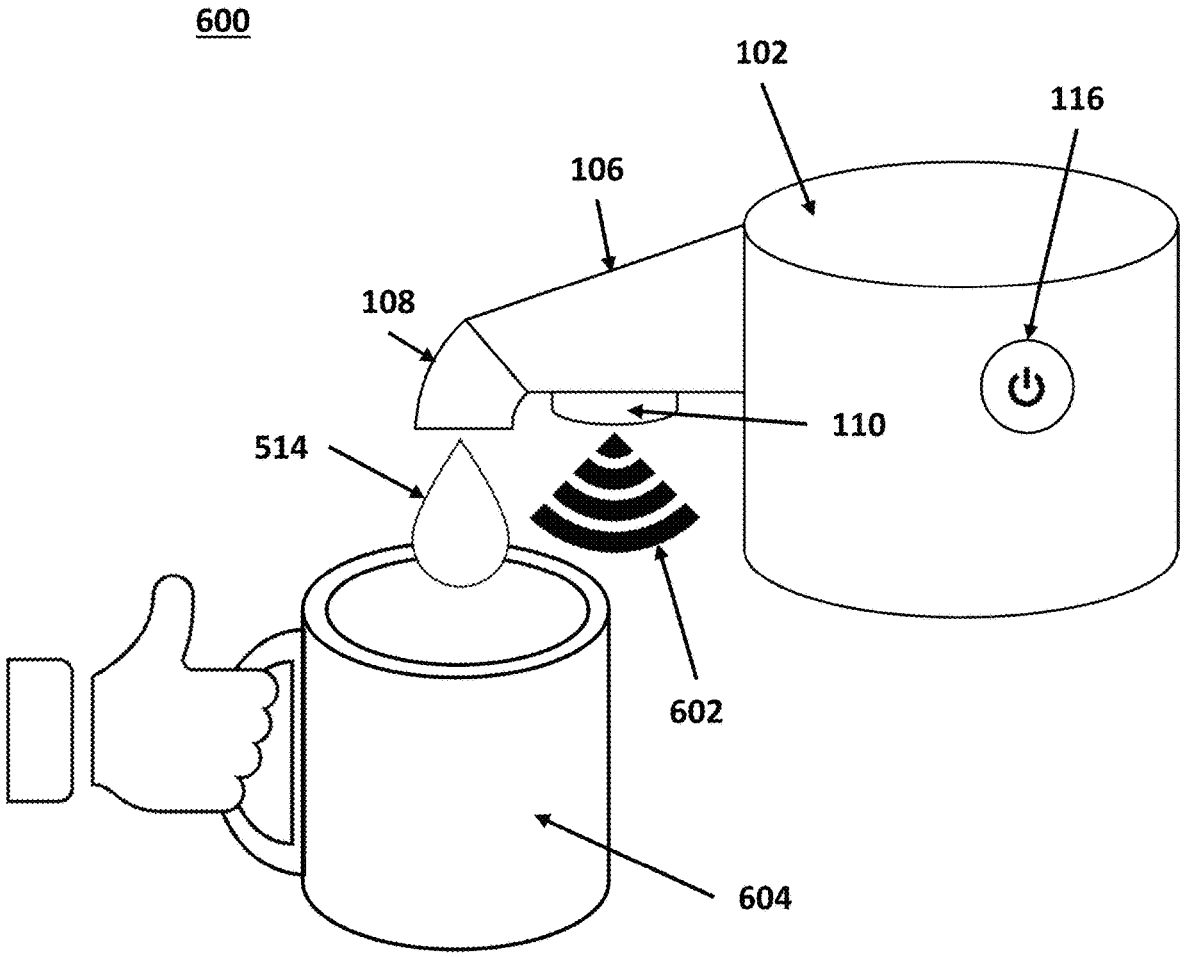
Figure 7:
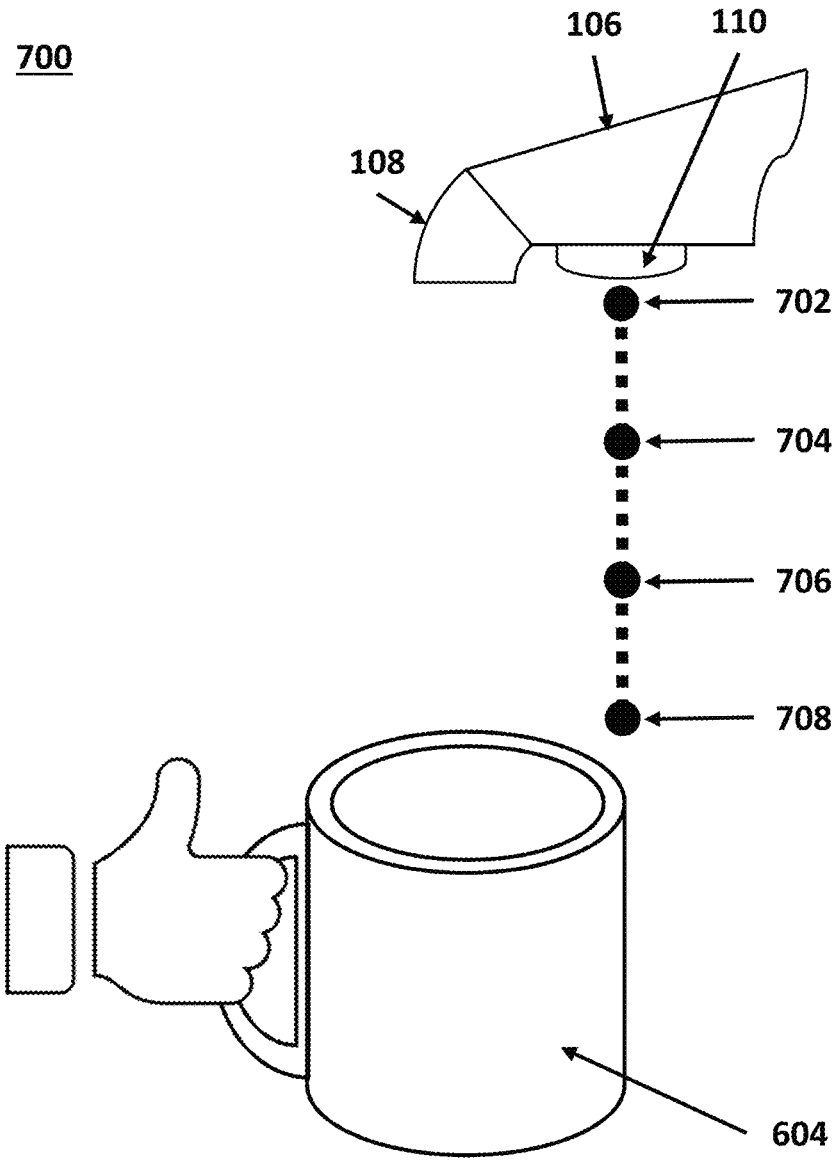
Figure 8:
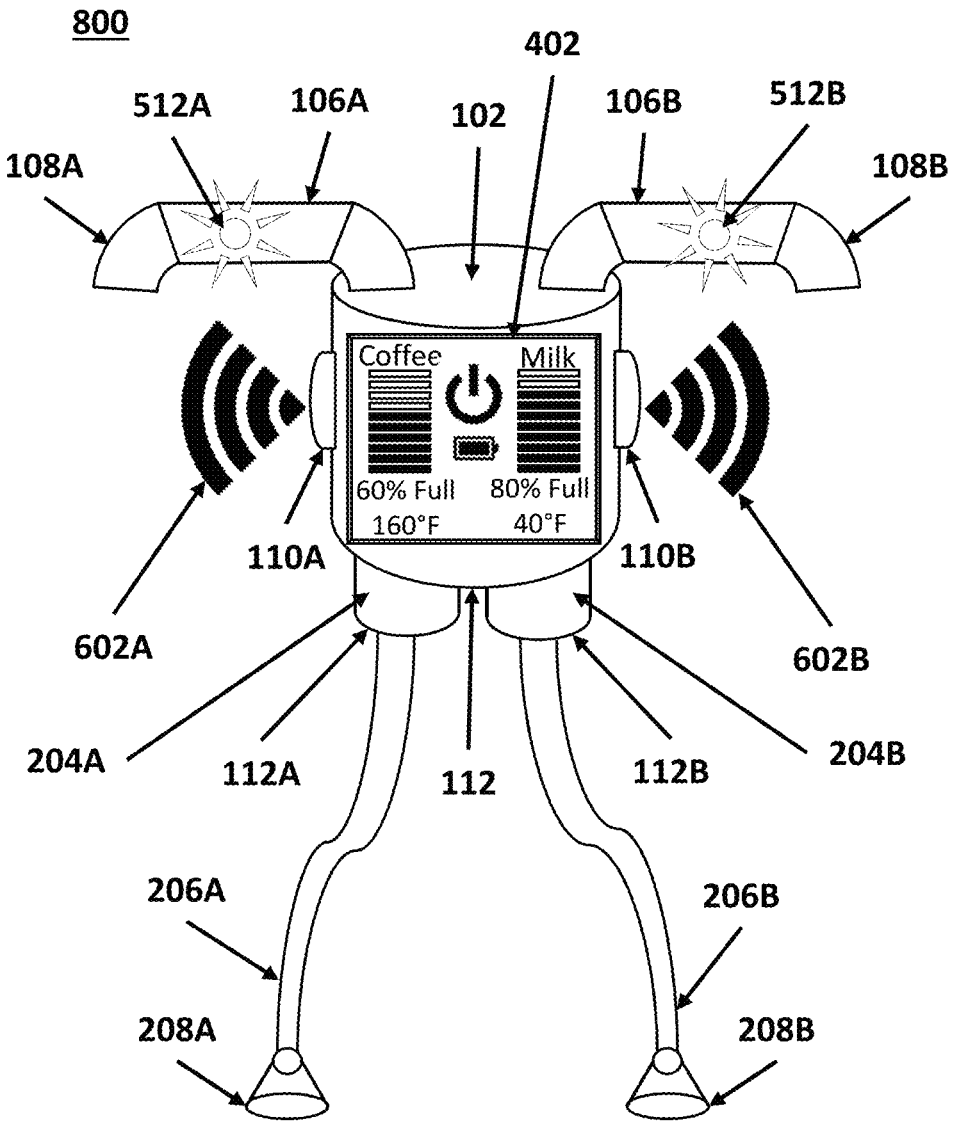
Figure 9:
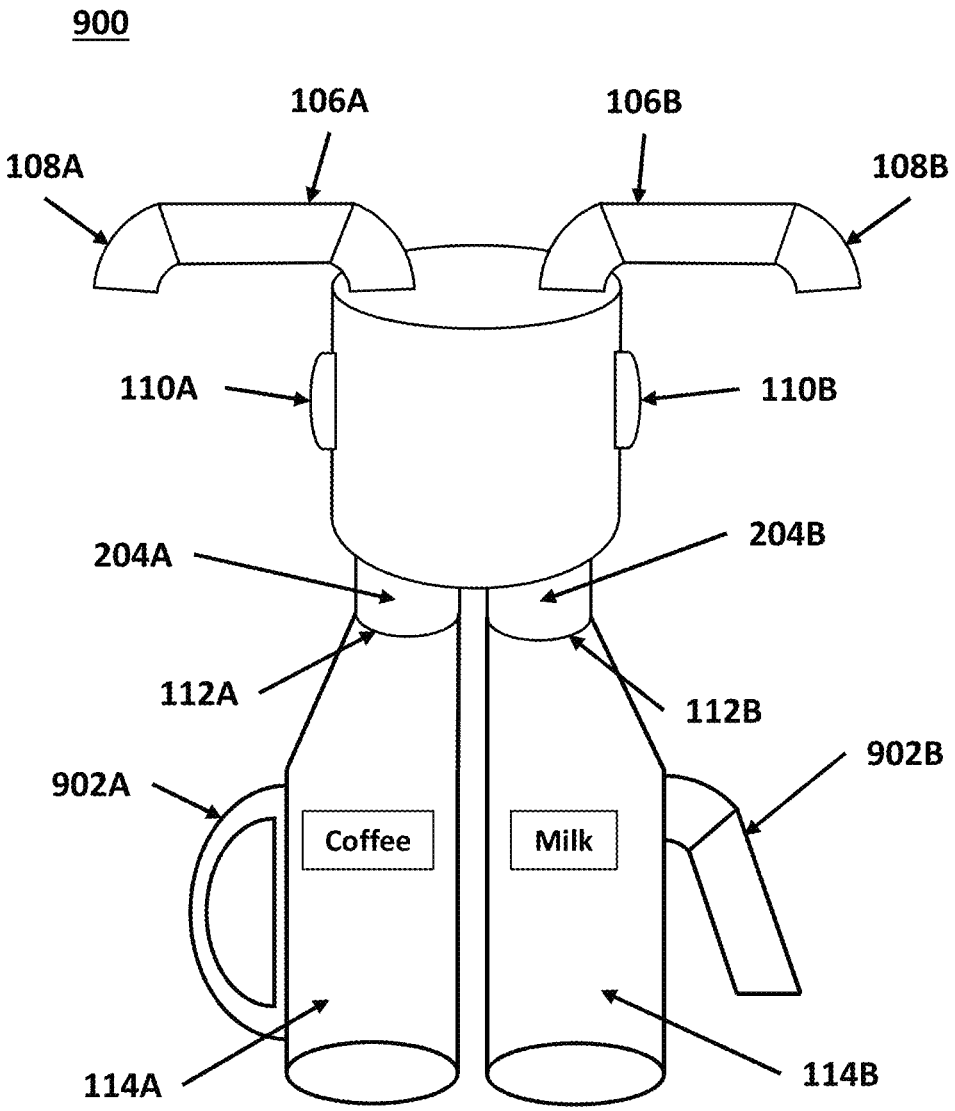
Figure 10:
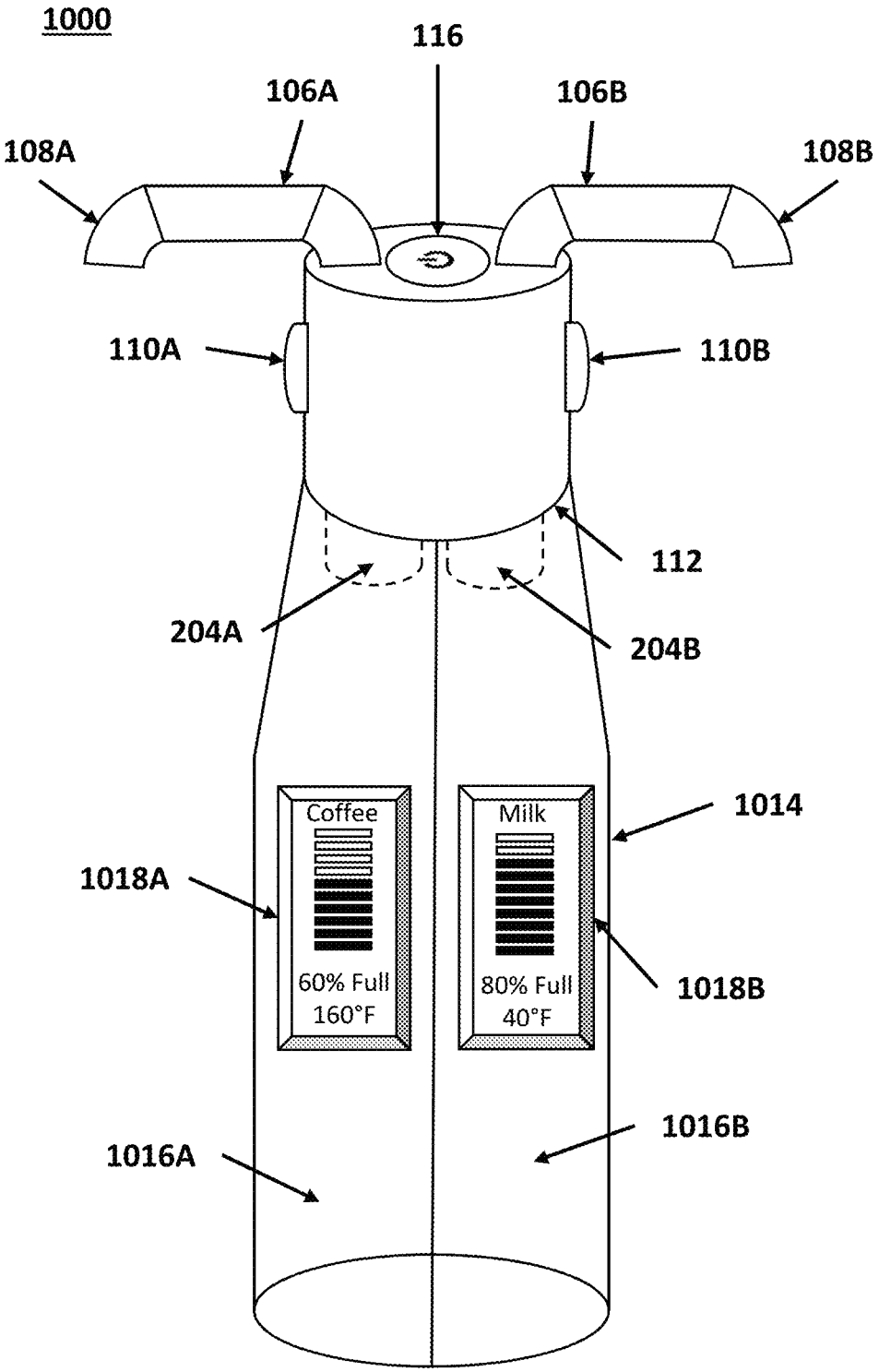
Figure 12:
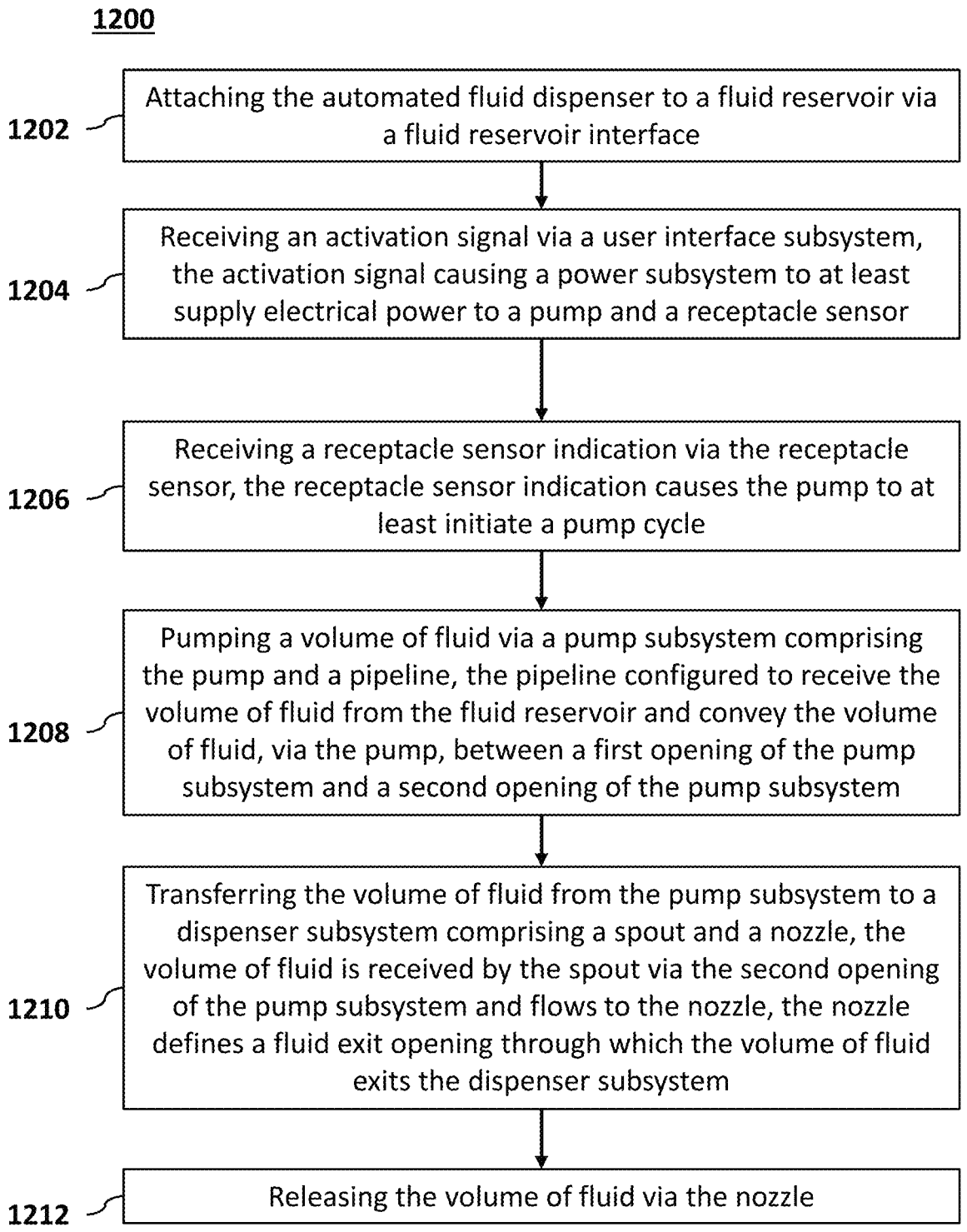
Figure 13:
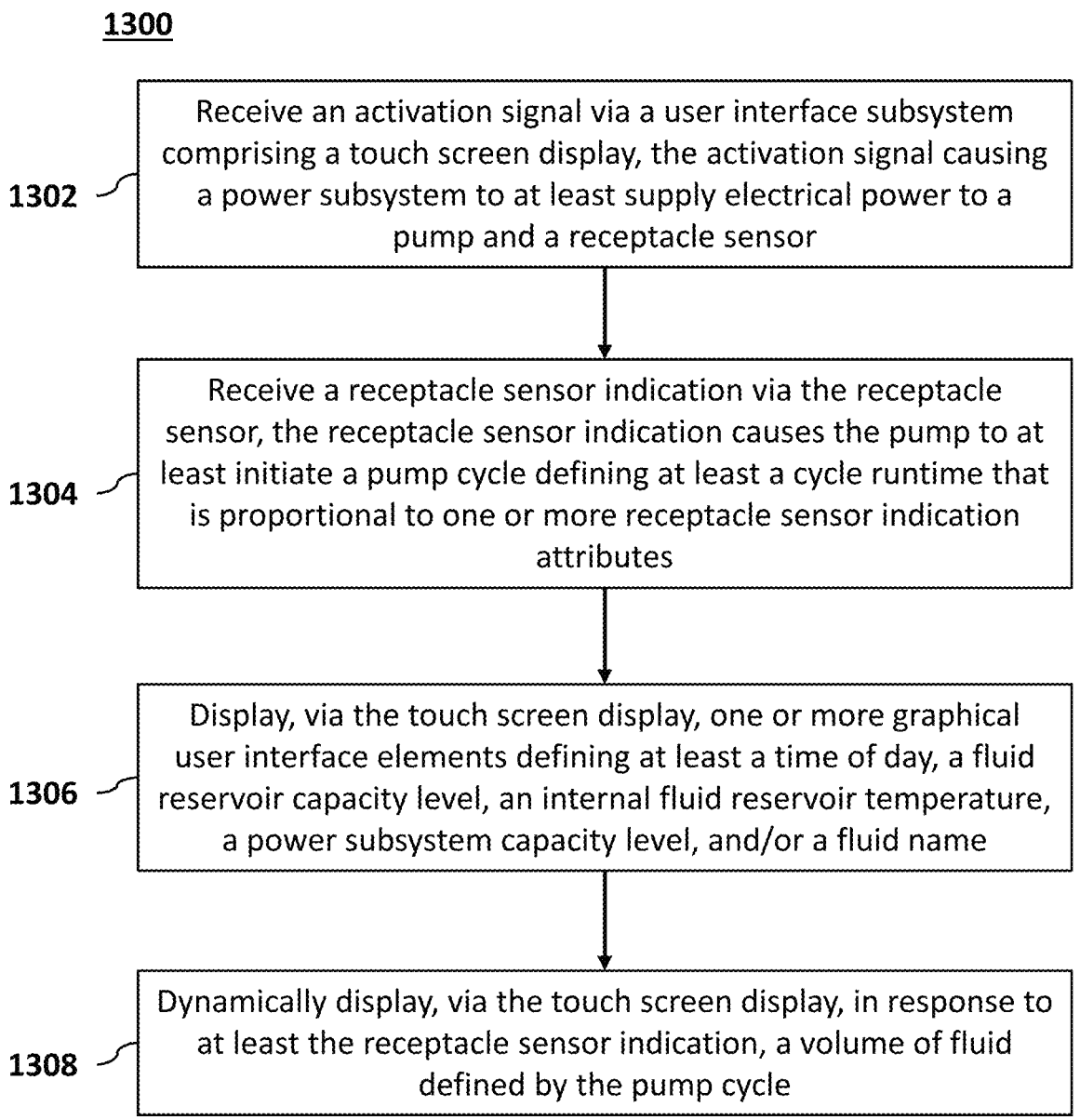

Having thus described embodiments of the disclosure in general terms, reference will now be made to the accompanying drawings, which are not necessarily drawn to scale, and wherein:

FIG. 1 illustrates an example perspective view of an automated fluid dispenser attached to a fluid reservoir, according to some embodiments;

FIG. 2 illustrates an example perspective view of an automated fluid dispenser with a flexible pipeline hose, according to some embodiments;

FIG. 3 illustrates an example bottom-up plane view of an automated fluid dispenser with a flexible pipeline hose, according to some embodiments;

FIG. 4 illustrates an example perspective view of an automated fluid dispenser with a touch screen display configured with graphical user interface elements, according to some embodiments;

FIG. 5 illustrates an example perspective view of an automated fluid dispenser with user interface elements and a display configured with graphical user interface elements, according to some embodiments;

FIG. 6 illustrates an example perspective view of an automated fluid dispenser dispensing fluid to a detected fluid receptacle, according to some embodiments;

FIG. 7 illustrates an example perspective view of a dispenser subsystem and fluid receptacle with a plurality of detection distances therebetween, according to some embodiments;

FIG. 8 illustrates an example perspective view of an automated fluid dispenser, according to some embodiments;

FIG. 9 illustrates an example perspective view of an automated fluid dispenser attached to a plurality of fluid reservoirs, according to some embodiments;

FIG. 10 illustrates an example perspective view of an automated fluid dispenser attached to an example fluid reservoir, according to some embodiments;

FIGS. 11A, 11B, 11C, and 11D illustrate an example automated fluid dispenser, according to some embodiments;

FIG. 12 is a flowchart of operations for dispensing a volume of fluid, with an example automated fluid dispenser, in response to detection of an example fluid receptacle, in accordance with example embodiments of the present disclosure; and FIG. 13 is a flowchart of operations for activating a pump cycle, of an example automated fluid dispenser, in response to receipt of an example activation signal, in accordance with example embodiments of the present disclosure.

DETAILED DESCRIPTION

Some embodiments of the present disclosure will now be described more fully hereinafter with reference to the accompanying drawings, in which some, but not all, example embodiments are shown. Indeed, various embodiments can be embodied in many different forms and should not be construed as limited to the embodiments set forth herein; rather, these example embodiments are provided so that this disclosure will satisfy applicable legal requirements. The term "or" is used herein in both the alternative and conjunctive sense, unless otherwise indicated. The terms "illustrative," "exemplary," and the like are used to be examples with no indication of quality level. As used herein, the term "along," and similarly utilized terms, means near or on, but not necessarily requiring directly on, an edge or other referenced location. Additionally, the term "attachment surface," and similarly utilized terms, means the part of the first component body to which at least one second component is attached, connected, or integrated. As used herein, the term "expandable," and similarly utilized terms, refers to one or more components capable of transitioning between two or more configurations and does not suggest a directionality (e.g., "expandable" may comprise contraction, expansion, or other movement). Further, the terms "angle," "angled," "bend angle," and similarly utilized terms, refer to an angle between zero and 180 degrees.

As used herein, the term 'circuitry' refers to: (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. Additionally, the term "circuitry" may refer to purpose built circuits fixed to one or more circuit boards, for example, a baseband integrated circuit, a cellular network device or other connectivity device (e.g., Wi-Fi card, Bluetooth® circuit, etc.), a sound card, a video card, a motherboard, and/or other computing device.

As used herein, the terms "data," "content," "digital content," "information," and similar terms may be used interchangeably to refer to data capable of being transmitted, received, and/or stored in accordance with embodiments of the present disclosure. Further, where a computing device is described herein to receive data from another computing device, it will be appreciated that the data may be received directly from another computing device or may be received indirectly via one or more intermediary computing devices, such as, for example, one or more servers, relays, routers, network access points, base stations, hosts, and/or the like, sometimes referred to as a "network." Similarly, where a computing device is described herein to send data to another computing device, it will be appreciated that the data may be sent directly to another computing device or may be sent indirectly via one or more intermediary computing devices, such as, for example, one or more servers, relays, routers, network access points, base stations, hosts, and/or the like.

The terms "computer-readable storage medium" refers to a non-transitory, physical or tangible storage medium (e.g., volatile or non-volatile memory), which may be differentiated from a "computer-readable transmission medium," which refers to an electromagnetic signal. Such a medium can take many forms, including, but not limited to a non-transitory computer-readable storage medium (e.g., non-volatile media, volatile media), and transmission media. Transmission media include, for example, coaxial cables, copper wire, fiber optic cables, and carrier waves that travel through space without wires or cables, such as acoustic waves and electromagnetic waves, including radio, optical, infrared waves, or the like. Signals include man-made, or naturally occurring, transient variations in amplitude, frequency, phase, polarization or other physical properties transmitted through the transmission media.

Examples of non-transitory computer-readable media include, without limitation, a random access memory (RAM), a programmable read only memory (PROM), an erasable programmable read only memory (EPROM), a FLASH-EPROM, or any other non-transitory medium from which a computer can read. The term computer-readable storage medium is used herein to refer to any computer-readable medium except transmission media. However, it will be appreciated that where embodiments are described to use a computer-readable storage medium, other types of computer-readable mediums can be substituted for or used in addition to the computer-readable storage medium in alternative embodiments.

Like reference numerals refer to like elements throughout. Thus, use of any such terms should not be taken to limit the spirit and scope of embodiments of the present invention.

With reference to FIGS. 1-3 various structural elements of example embodiments will be described in further detail. FIG. 1 illustrates an example perspective view of an example automated fluid dispenser 100 attached to an example fluid reservoir 114, according to some embodiments. As shown in FIG. 1, an example automated fluid dispenser comprises a housing which comprises housing body 102. Housing body 102 defines a top surface, a circular sidewall, and a bottom surface. The top surface of housing body 102 comprises a user interface element 116 which is depicted as a push button partially embedded in the top surface of housing body 102. The bottom surface of housing body 102 defines a fluid reservoir interface 112 that, at least temporarily, attaches the automated fluid dispenser 100 to fluid reservoir 114. In some embodiments, the fluid reservoir interface 112 may include, without limitation, one or more of a threaded surface, a flexible seal (e.g., O-ring, etc.), or the like, configured to produce at least a watertight seal between the automated fluid dispenser 100 and the fluid reservoir 114. As illustrated in FIG. 1, handle 104 and spout 106 are attached to housing body 102 via the circular sidewall of housing body 102. In some embodiments, handle 104, spout 106, or the like, may be, at least partially, integrated into housing body 102.

For example, at least handle 104, spout 106, and the circular sidewall of housing body 102 may be defined by a single piece of material, such as injection molded plastic or cast aluminum. In such an embodiment, the top surface and bottom surface of housing body 102 may be attached to at least the sidewall via chemical or mechanical attachment means. In some embodiments, mechanical attachment means may comprise one or more of a lap seam, countersunk lap seam, outside lap seam, screw, bolt, nut, threaded surface, weld, pin, clip, press fit, friction lock, the like, or combinations thereof. In some embodiments, chemical attachment means may comprise one or more of a reactive adhesive, a non-reactive adhesive, a natural adhesive, a synthetic adhesive, a polyurethane resin, a thermoset epoxy, a cyanoacrylate, a pressure-sensitive adhesive (e.g., tape, etc.), the like, or combinations thereof. In some embodiments, the top surface and/or bottom surface of housing body 102 may be, at least partially, integrated into the circular sidewall (e.g., via injection molding, additive manufacturing, investment casting, or the like).

Referring to FIG. 1, spout 106 is further connected to receptacle sensor 110 and nozzle 108. Receptacle sensor 110 may be one or more of a motion sensor, distance sensor, light curtain sensor, camera, or the like configured to detect the presence of a fluid receptacle (not shown) within a dispensable proximity of nozzle 108. Nozzle 108 may be attached to spout 106 via one or more chemical or mechanical attachment means. In some embodiments, nozzle 108 may comprise a filter element (not shown) to prevent, or reduce the likelihood of, contaminants (e.g., insects, dirt, dust, bacteria, foreign fluids, etc.) from entering spout 106. In some embodiments, spout 106, receptacle sensor 110, nozzle 108, or the like, may comprise a light emitting diode (LED). For example, nozzle 108 may comprise an LED that is configured to blink to indicate fluid is about to be dispensed and the LED maybe further configured to light up continuously (i.e., a solid light, not flashing/blinking) when fluid is being dispensed via nozzle 108. In some embodiments, receptacle sensor 110 may be integrated into nozzle 108. For example, receptacle sensor 110 may comprise a light curtain sensor that is, at least partially, attached to, or embedded in, a perimeter defined by nozzle 108.

FIG. 2 illustrates an example perspective view of an automated fluid dispenser 200 with a flexible embodiment of pipeline hose 206, in accordance with some embodiments. Automated fluid dispenser 200 comprises housing body 102 that defines housing body opening 202 (e.g., 202A, 202B). Housing body opening 202A is shown by FIG. 2 positioned on the top surface of housing body 102 and housing body opening 202B is positioned on the sidewall of housing body 102. In some embodiments, housing body opening 202A may be a pressure release vent configured to release excess pressure from, for example, the pump subsystem or the fluid reservoir. In some embodiments, housing body opening 202B may be configured to provide access to a power input or communication port. For example, housing body opening 202B may comprise a USB port used for updating circuitry firmware/software and charging a power subsystem (e.g., a rechargeable battery, etc.).

As depicted in FIG. 2, housing body 102 of automated fluid dispenser 200 comprises housing extension 204 attached to the top surface of housing body 102. In some embodiments, housing extension 204 may be attached to housing body 102 via any surface defined by housing body 102 (e.g., the bottom surface, sidewall, an integrated spout/handle, etc.). Housing extension 204 may be integrated into housing body 102 (e.g., via injection molding processes of manufacture, etc.) or housing extension 204 may be a separate housing component attached via chemical attachment means (e.g., superglue, etc.) and/or mechanical attachment means (e.g., machine screws, etc.). In some embodiments, housing extension 204 may be configured to house one or more additional components, modules, or subsystems. For example, housing extension 204 may be configured to house one or more of a circuit board, a battery, an LED, a sensor, a microphone, a speaker, a dial, or the like.

In some embodiments, housing extension 204 can comprise a mechanical mechanism, for example, a pressure release valve, a button, a locking screw, an electrical pump, a mechanical handpump, the like, or combinations thereof. In some embodiments, housing extension 204 may define a cylindrical shape, a circular shape, a semi-spherical shape, a spherical shape, a square shape, a rectangular shape, a frustoconical shape, a pyramid, a cube, the like, or combinations thereof. In some embodiments, housing extension 204 may comprise one or more materials. For example, in an instance housing extension 204 houses an LED, housing extension 204 may comprise a transparent glass or plastic material that allows the LED's light to pass through. For example, in an instance housing extension 204 houses a push button, housing extension 204 may comprise a rubber or silicone material which can bend and flex as the push button is pressed and released. In some embodiments, housing extension 204 may comprise a plurality of housing extensions attached to one or more surfaces defined by automated fluid dispenser 200 or subsystems thereof.

FIG. 2 further depicts pipeline hose 206 associated with the pump subsystem (not shown). Pipeline hose 206 is illustrated as attached a sinker 208, defining a frustum shape (e.g., a frustum sinker), at a first end and to the bottom surface of housing body 102 at a second end. In some embodiments, pipeline hose 206 may comprise a transparent silicone material. It will be appreciated, in light of the present disclosure, that the transparent silicone material allows the pipeline hose 206 to be inserted into a variety of fluid reservoir openings and allows a user to easily identify obstructions (e.g., juice pulp, pits, seeds, etc.) within the hose that may need to be cleared (e.g., during cleaning operations, by replacing the hose, etc.). Sinker 208 may comprise a weight (e.g., a mass of stainless steel, or other material(s), at least partially, coated/sealed/encased in silicone) that holds the first end of pipeline hose 206 near the bottom of a fluid reservoir (e.g., 114 or the like). In some embodiments, pipeline hose 206 may comprise a rigid or semi-rigid material (e.g., stainless steel straw, nylon-reinforced rubber, etc.).

In some embodiments, sinker 208 may comprise one or more filter elements, as described by the present disclosure. For example, a stainless steel mesh sphere that, at least partially, covers an opening defined by pipeline hose 206 and thereby reduces the likelihood of obstructions (e.g., juice pulp, pits, seeds, etc.) from entering the pipeline hose 206. In some embodiments, sinker 208 defines a cylindrical shape, a circular shape, a semi-spherical shape, a spherical shape, a square shape, a rectangular shape, a frustoconical shape, a pyramid, a cube, the like, or combinations thereof. It will be appreciated, in light of the present disclosure, that the geometry, and/or filter element(s), defined by sinker 208 may be selected to maximize fluid removal from the fluid reservoir while simultaneously preventing the opening defined by pipeline hose 206 from being stuck against a portion of the fluid reservoir (e.g., by suction force generated by the pump system).

FIG. 3 illustrates an example bottom-up plane view of an automated fluid dispenser 300 with a flexible pipeline hose, according to some embodiments. As depicted in FIG. 3, the bottom surface of housing body 102 defines a plurality of openings. Fluid reservoir vent openings 302 are illustrated at multiple positions around the bottom surface area and are at least partially covered by mesh screens. In some embodiments, fluid reservoir vent openings 302 may extend through the housing body 102 to an exterior surface (e.g., a top surface) and connect with, for example, housing body opening 202A to vent pressure (e.g., vacuum pressure buildup from the pump subsystem, etc.) and/or gases (e.g., carbon dioxide ($CO_2$) from carbonated beverages, etc.) to an exterior environment. In some embodiments, one or more filter elements may be inserted into, or attached over, fluid reservoir vent openings 302 to prevent exterior contaminants (e.g., dirt, dust, etc.) from reaching the fluid reservoir. In some embodiments, one or more pressure release valves may be inserted into, or attached over, fluid reservoir vent openings 302 to allow for the buildup of pressure (e.g., by the pump subsystem) within a certain threshold limit (e.g., pressure buildup less than 14.7 PSI).

Pump pipeline opening 304 is illustrated at the center position of the bottom surface area and is the attachment point by which pipeline hose 206 attaches to housing body 102. In embodiments, pump pipeline opening 304 may comprise a hose nipple (e.g., threaded into housing body 102, integrated into the bottom surface of housing body 102, etc.) by which pipeline hose 206 attaches to housing body 102. In embodiments, pipeline hose 206 may continue through pump pipeline opening 304 and attach directly to an intake of a pump. In some embodiments, pump pipeline opening 304 may be sealed. For example, pump pipeline opening 304 may contain, at least partially, one or more of an O-ring, a chemical sealant, such as silicone adhesive, or the like. In some embodiments, a pipeline hose may be inserted into pump pipeline opening 304 in accordance with an interference fit (i.e., a press fit, a friction fit, etc.) to substantially reduce fluid from passing between the outer surface of the hose and the inner surface defined by pump pipeline opening 304.

FIG. 4 illustrates an example perspective view of an automated fluid dispenser 400 configured with a touch screen display 402 comprising a plurality of example graphical user interface elements 402A-G, according to some embodiments. As illustrated the user interface subsystem of automated fluid dispenser 400 comprises touch screen display 402 that is configured to render a plurality of graphical user interface elements 402A-G and receive at least user interaction signal 404. As depicted by FIG. 4, touch screen display 402 is attached to the sidewall of housing body 102. In some embodiments, touch screen display 402 may be communicably connected, such as via wired electrical pathways through housing body openings (e.g., 202A, 202B, etc.), to one or more other user interface subsystem components (e.g., a motion sensor, microphone, etc.) or one or more other subsystems (e.g., power subsystem, pump subsystem, etc.). In some embodiments, the user interface subsystem may comprise one or more computing circuits that comprise at least one processor, at least one memory, and computer program code instructions associated with one or more functional features attributed to touch screen display 402 as discussed by the present disclosure.

In some embodiments, the user interface subsystem may be communicably connected via a wired/wireless connection (e.g., Bluetooth®, Wi-Fi, etc.) to a computing device (e.g., laptop, smart device, tablet, desktop, etc.) via a network. For example, embodiments may provide notifications (e.g., text message alerts, table number, other location information, etc.) to a computing device (e.g., waiter's tablet computer, smart phone, manager's desktop, etc.) within a restaurant to notify restaurant staff that the automated fluid dispenser 400 needs to be, for example, charged, filled, cleaned, and/or the like. The network may include any wired or wireless communication network including, for example, a wired or wireless local area network (LAN), personal area network (PAN), metropolitan area network (MAN), wide area network (WAN), the like, or combinations thereof, as well as any hardware, software and/or firmware required to implement the network (e.g., network routers, switches, extenders, etc.). For example, the network may include a cellular telephone, an 802.11, 802.16, 802.20, and/or WiMAX network. Further, the network may include a public network, such as the Internet, a private network, such as an intranet, or combinations thereof, and may utilize a variety of networking protocols now available or later developed including, but not limited to Transmission Control Protocol/Internet Protocol (TCP/IP) based networking protocols. In some embodiments, the protocol is a custom protocol of JavaScript Object Notation (JSON) objects sent via a Web Socket channel. In some embodiments, the protocol is JSON over RPC, JSON over REST/HTTP, the like, or combinations thereof.

As depicted in FIG. 4, touch screen display 402 is configured to render a plurality of graphical user interface elements 402A-G. Graphical user interface element 402A comprises a plurality of bars representative of a capacity and fill level of the fluid reservoir (not shown) attached to automated fluid dispenser 400. In some embodiments, as fluid is dispensed from the fluid reservoir by automated fluid dispenser 400, in response one or more bars of the plurality of bars representative of the fluid reservoir's total capacity will be displayed, for example, in white and the one or more bars of the plurality of bars representative of the fluid reservoir's remaining fluid level will be rendered, for example, in black. In some embodiments, graphical user interface element 402A may comprise a text based indication associated with the fluid reservoir contents (e.g., "Full," "Please Refill," "Milk," "Coffee," "Juice," "Apple," "Orange," etc.). For example, as shown in FIG. 4, the fluid reservoir's remaining fluid level is represented by "70% Full" in addition to the plurality of bars. In some embodiments, the capacity and fill level of the fluid reservoir may be detected, at least partially, via one or more sensors (e.g., a fill sensor, a volume sensor, etc.) and/or it may be determined, at least partially, based on one or more predefined values (e.g., a known maximum capacity of the fluid reservoir). For example, the remaining fluid level may be determined by subtracting a volume of fluid measured and dispensed by the automated fluid dispenser 400 from a known maximum volume of an associated fluid reservoir. In some embodiments, a user (e.g., a waiter at a restaurant, etc.) may entered the maximum volume capacity, or the remaining fluid fill level, via user interaction signal 404.

Graphical user interface element 402B, as depicted in FIG. 4, comprises a date and a time indication (e.g., "06:56 AM" and "Sep. 8, 2020"). In some embodiments, the date and time may be determined via network connection by accessing, for example, a predefined website address. In some embodiments, the date and time may be received via one or more user interaction signals (e.g., user interaction signal 404, or the like).

Graphical user interface element 402C comprises a timer icon. In some embodiments, graphical user interface element 402C may be configured to provide a count down functionality. For example, in a coffee shop a carafe may be replaced every hour to ensure food safety and graphical user interface element 402C may be set to countdown from 1 hour to ensure replacement of the carafe in a timely manner. In some embodiments, graphical user interface element 402C can be configured to display the count down timer in real-time via touch screen display 402, or the like. In some embodiments, a notification may be transmitted (e.g., via a network to a computing device associated with the coffee shop) to alert staff that the carafe associated with automated fluid dispenser 400 is ready to be replaced.

Graphical user interface element 402D is configured to display, in real-time, a temperature associated with a fluid reservoir (not shown). In some embodiments, graphical user interface element 402D may comprise a graphical icon (e.g., a thermometer, etc.) and/or a text based message (e.g., "Temperature of 40° F." or the like). In some embodiments, graphical user interface element 402D may be associated with one or more temperature sensors connected to automated fluid dispenser 400 (e.g., a thermistor, thermopile, etc.) and configured to measure a fluid temperature.

As shown in FIG. 4, graphical user interface element 402E is a digital on/off switch. In some embodiments, graphical user interface element 402E is configured to receive user interaction signal 404 and, at least partially, turn-off one or more subsystems of automated fluid dispenser 400. For example, graphical user interface element 402E may receive user interaction signal 404 and in response the power subsystem may turn-off electrical current to the pump subsystem and reduce electrical current to the user interface subsystem. In some embodiments, a reduced amount of electrical current or voltage may be provided to the user interface subsystem to maintain graphical user interface element 402E, via touch screen display 402, so that another user interaction signal 404 may be received to turn-on one or more subsystems.

Graphical user interface element 402F, as shown in FIG. 4, is configured to display a status associated with a power subsystem. In some embodiments, graphical user interface element 402F may display a charging icon to indicate to a user that a battery associated with automated fluid dispenser 400 is being charged. In some embodiments, graphical user interface element 402F may indicate a power level and/or battery capacity (e.g., a battery charge level or a battery capacity, etc.). In some embodiments, graphical user interface element 402F may comprise a text based message (e.g., "25% Charged," "Please Charge," or the like).

Graphical user interface element 402G, as illustrated by FIG. 4, is a digital function switch. In some embodiments, graphical user interface element 402G may be configured to receive user interaction signal 404 and, in response, cause at least a pump subsystem to initiate a pump cycle. For example, a user may press on graphical user interface element 402G and, in response, automated fluid dispenser 400 dispenses a volume of fluid. In some embodiments, the volume of fluid dispensed in response to a user interaction with graphical user interface element 402G may be proportional to a period of time (e.g., an amount of time a user presses graphical user interface element 402G) or the volume of fluid may be predefined (e.g., 1 ounce of fluid per interaction signal received).

In some embodiments, graphical user interface elements 402A-G may be configured to receive via one or more user interaction signals (e.g., user interaction signal 404, or the like) that render an associated graphical user interface (e.g., a setup menu, etc.). For example, a user may press and hold graphical user interface element 402B and, after a predefined time (e.g., 5 seconds), the user interface subsystem, via touch screen display 402, may render a graphical user interface input menu associated with graphical user interface element 402B (e.g., a menu to enter a date and time value to associate with graphical user interface element 402B).

FIG. 5 illustrates an example perspective view of an automated fluid dispenser 500 with user interface elements (e.g., 506, 508, 510, 512, etc.) and a display device 502 configured with graphical user interface elements (e.g., 402A), according to some embodiments. As shown, automated fluid dispenser 500 comprises push button user interface elements (e.g., 506, 508, 510) attached to the sidewall of housing body 102. Push button user interface element 510 is a power-on push button configured to receive user interaction signal 504 and, at least partially, turn-on one or more subsystems of automated fluid dispenser 500. Push button user interface element 506 is a power-off push button configured to receive user interaction signal 504 and, at least partially, turn-off one or more subsystems of automated fluid dispenser 500.

Push button user interface element 508 is a dispense function push button configured to receive user interaction signal 504 and, in response, cause at least a pump subsystem to initiate a pump cycle. For example, a user may press on push button user interface element 508 and, in response, automated fluid dispenser 500 dispenses a volume of fluid. In some embodiments, the volume of fluid dispensed in response to a user interaction with push button user interface element 508 may be proportional to a period of time (e.g., an amount of time a user presses push button user interface element 508) or the volume of fluid may be predefined (e.g., 1 ounce of fluid per press of push button user interface element 508). In some embodiments, a push button user interface element may comprise a label (e.g., printed on, engraved in, etc. the push button user interface element). For example, push button user interface element 508 is illustrated, in FIG. 5, with a printed text label of "Pour" to indicate the function associated with push button user interface element 508 to a user.

Moreover, FIG. 5 depicts lighting user interface element 512. Lighting user interface element 512 may be one or more of a light emitting diode (LED), a compact fluorescent lamp (CFL), a halogen lamp, or the like. In some embodiments, lighting user interface element 512 may be a strip of lighting elements attached to or embedded in housing body 102, or the like (e.g., housing extension 204, spout 106, etc.). In some embodiments, lighting user interface element 512 may be configured to produce light in response to one or more functions associated with automated fluid dispenser 500. For example, push button user interface element 508 can receive user interaction signal 504 and, in response, automated fluid dispenser 500 may dispense a volume of fluid and lighting user interface element 512 may produce light during the dispensing operation. In some embodiments, lighting user interface element 512 may be configured to produce light of different colors to indicate different functions or conditions associated with automated fluid dispenser 500. For example, during the dispensing operations lighting user interface element 512 may emit a blinking red color light. Additionally, the fluid reservoir (not shown) associated with automated fluid dispenser 500 can be determined to be empty and, in response, lighting user interface element 512 may produce a solid purple color light. In some embodiments, lighting user interface element 512 may be configured to blink, strobe, or otherwise alternate between one or more colors.

FIG. 6 illustrates an example perspective view of an automated fluid dispenser 600 dispensing a fluid 514 to a detected fluid receptacle 604, according to some embodiments. As illustrated, a user can bring fluid receptacle 604 (e.g., a coffee mug) within range of receptacle sensor detection signal 602 associated with receptacle sensor 110. In some embodiments, receptacle sensor detection signal 602 may be defined by one or more sensor types. For example, a light curtain sensor embodiment of receptacle sensor 110 may define a linear light beam embodiment, of receptacle sensor detection signal 602, that extends from receptacle sensor 110 to a table top surface supporting automated fluid dispenser 600. In such embodiments, fluid receptacle 604 may be placed beneath receptacle sensor 110 thereby breaking the light curtain sensor's linear light beam (i.e., receptacle sensor detection signal 602) and causing the light curtain sensor to transmit an output signal to the pump subsystem (e.g., to cause an initiation of a pump cycle operation).

In some embodiments, receptacle sensor detection signal 602 may define one or more of a detection signal length, a detection signal width, a detection signal area, a detection signal shape, or the like. For example, receptacle sensor detection signal 602 may define a frustoconical detection zone that extends 5 inches below receptacle sensor 110. In some embodiments, receptacle sensor detection signal 602 may be visible (e.g., a colored light beam, etc.). In some embodiments, receptacle sensor detection signal 602 may be a line of sight of a camera (i.e., receptacle sensor 110) configured for object recognition based detection (e.g., a camera configured with object recognition circuitry to differentiate fluid receptacle 604 from other objects). For example, a camera (i.e., receptacle sensor 110), configured for object recognition based detection, may detect a coffee mug and dispense hot coffee (i.e., fluid 514) but if a hand is detected the camera (i.e., receptacle sensor 110) is configured not to dispense fluid 514. It will be appreciated, in light of the present disclosure, that such object recognition based detection embodiments can be utilized to prevent personal injury to users by preventing hot fluid from contacting a user's bare skin and may also prevent fluid from being dispensed without a receptacle present to catch/contain the fluid.

FIG. 7 illustrates an example perspective view of a dispenser subsystem and a fluid receptacle 604 with a plurality of detection distances (e.g., 702, 704, 706, 708) therebetween, in accordance with some embodiments of the present disclosure. As illustrated in FIG. 7, receptacle sensor 110 is configured to detect fluid receptacle 604 and determine an approximate position and/or distance of fluid receptacle 604 relative to one or more components of the dispenser subsystem (e.g., receptacle sensor 110, nozzle 108, etc.). In some embodiments, receptacle sensor 110 may determine that fluid receptacle 604 is beneath nozzle 108 but is beyond detection distance 708 and therefore fluid is not dispensed.

In some embodiments, receptacle sensor 110 may determine that fluid receptacle 604 is beneath nozzle 108 and is within detection distance 708 and therefore fluid is dispensed. In some embodiments, a particular volume of fluid is dispensed based on a determined detection distance or a range of determined detection distances. For example, detection distance 708 may correspond to a pump cycle operation that causes 1 ounce of fluid to be dispensed and detection distance 706 may correspond to a pump cycle operation that causes 2 ounces of fluid to be dispensed. Moreover, detection distance 704 and 702 may correspond to 3 ounces and 4 ounces respectively. Alternatively, any detection distance between detection distance 708 and 706 may correspond to a pump cycle operation that causes 2 ounces of fluid to be dispensed. In some embodiments, a user may have to hold fluid receptacle 604, approximately, at a particular detection distance (e.g., 702, etc.) for a predefined period of time (e.g., 3 seconds, etc.) before a respective volume of fluid (e.g., 4 ounces, etc.) will be dispensed.

In some embodiments, the volume of fluid (e.g., 4 ounces, etc.) may be indicated to a user via a display device (e.g., touch screen display 402, lighting user interface element 512, etc.). For example, lighting user interface element 512 may blink 3 times with a green colored light to indicate to a user that 3 ounces of fluid will be dispensed. Alternatively, or additionally, touch screen display 402 may display a text based message to the user, for example "Dispensing 3 Ounces Of Milk" prior to, during, or after initiation of a pump cycle operation.

FIG. 8 illustrates an example perspective view of an automated fluid dispenser 800, according to some embodiments. As illustrated by FIG. 8, example automated fluid dispenser 800 comprises at least two pump subsystems, at least two dispenser subsystems, and at least one user interface subsystem with touch screen display 402. As illustrated, touch screen display 402 is configured to display one or more graphical user interface elements associated with at least two fluid reservoirs (not shown). The first dispenser subsystem comprises nozzle 108A, spout 106A, and lighting user interface element 512A, and the first dispenser subsystem is attached to housing body 102. The second dispenser subsystem comprises nozzle 108B, spout 106B, and lighting user interface element 512B, and the second dispenser subsystem is also attached to housing body 102.

At least one sensory subsystem comprises receptacle sensors 110A and 110B that define receptacle sensor detection signal 602A and 602B respectively. As shown in FIG. 8, receptacle sensors 110A and 110B are associated with at least the first dispenser subsystem and the second dispenser subsystem respectively. The first pump subsystem comprises housing extension 204A, pipeline hose 206A, and sinker 208A. The second pump subsystem comprises housing extension 204B, pipeline hose 206B, and sinker 208B. In some embodiments, housing extensions 204A and 204B contain, at least partially, a first pump of the first pump subsystem and a second pump of the second pump subsystem respectively. In some embodiments, a fluid reservoir (not shown) may be attached to housing body 102 by way of fluid reservoir interface 112. In such embodiments, the fluid reservoir may be divided internally into at least two compartments and each compartment may be associated with either the first pump subsystem or the second pump subsystem. For example, the pipeline hose 206A and sinker 208A may be placed within a first compartment and pipeline hose 206B and sinker 208B may be placed within a second compartment. In other embodiments, at least pipeline hose 206A and pipeline hose 206B may be placed within a single fluid reservoir with a single internal compartment (e.g., fluid reservoir 114 or the like).

In some embodiments, similar subsystems (e.g., the first and second pump subsystems, etc.), and/or components thereof (e.g., pipeline hose 206B and sinker 208B, etc.), may be dissimilar embodiments of the same subsystem, and/or components thereof, as described by the present disclosure. For example, sinker 208A may define, at least partially, a cylindrical shape and comprise, at least partially, a stainless steel mesh sphere filter element, while sinker 208B may define a frustoconical shape without a filter element attached thereto. Additionally, for example, pipeline hose 206A may comprise an 8 inch long flexible silicone hose, while pipeline hose 206B may comprise a 5 inch long rigid stainless steel tube.

In some embodiments, the first pump subsystem and the second pump subsystem may be configured as an output pump subsystem and an intake pump subsystem respectively. For example, pipeline hose 206B may be configured as part of an intake pipeline that is configured to pressurize the fluid reservoir and pipeline hose 206A may be configured as part of an output pipeline that, at least partially, dispenses the pressurized contents of the fluid reservoir. In such example embodiments, nozzle 108B and spout 106B may be configured to receive air from the environment during a pressurizing pump cycle. Moreover, in such example embodiments, receptacle sensor 110B may be configured to receive an input (e.g., a hand motion, etc.) and in response cause the second pump subsystem to initiate a pumping cycle. In some embodiments, touch screen display 402 may display the internal fluid reservoir pressure (e.g., 1.5 atmospheres (ATM), 35 kilopascals (kPa), etc.) determined via a pressure sensor. In some embodiments, a user may indicate, via touch screen display 402, a predefined pressure threshold. For example, a user may indicate that the predefined pressure threshold is 5 PSI and if the internal reservoir pressure is detected to be below 5 PSI a pumping cycle will be initiated to pressurize the fluid reservoir to a value above the predefined pressure threshold (e.g., 10% above the threshold value, to another maximum predefined pressure threshold, etc.).

FIG. 9 illustrates a perspective view of an example automated fluid dispenser 900 attached to fluid reservoir 114A and fluid reservoir 114B, configured in accordance with some embodiments. As illustrated, fluid reservoir 114A is attached to automated fluid dispenser 900 by way of fluid reservoir interface 112A. Fluid reservoir 114B is attached to automated fluid dispenser 900 via fluid reservoir interface 112B.

In some embodiments, a first pump subsystem (e.g., at least partially housed in housing extension 204A) can pump fluid from fluid reservoir 114A and a second pump subsystem (e.g., at least partially housed in housing extension 204B) can pump fluid from fluid reservoir 114B. In some embodiments, a first pump subsystem may operate independently of a second pump subsystem. In some embodiments, a first fluid reservoir may be of a different configuration than a second fluid reservoir. For example, as shown in FIG. 9, fluid reservoir 114A comprises a D-shaped handle 902A and fluid reservoir 114B comprises a cantilever handle 902B. Moreover, fluid reservoir 114A may comprise heating elements (not shown) to warm fluid therein (e.g., coffee, etc.), and fluid reservoir 114B may comprise a refrigeration system (not shown) to cool fluid therein (e.g., milk, etc.).

FIG. 10 illustrates an example perspective view of an automated fluid dispenser 1000 attached to a fluid reservoir 1014, according to some embodiments. As illustrated, fluid reservoir 1014 comprises at least two internal compartments for housing a volume of fluid. Fluid reservoir compartment 1016A is depicted as associated with a display device 1018A that is attached to an outer surface of fluid reservoir 1014. Fluid reservoir compartment 1016B is depicted as associated with a display device 1018B that is attached to an outer surface of fluid reservoir 1014. In some embodiments, display devices 1018A and 1018B may each, at least partially, comprise a respective, or shared, user interface subsystem communicably connected to automated fluid dispenser 1000 via a contact connection that is engaged when fluid reservoir 1014 interfaces with automated fluid dispenser 1000 by way of fluid reservoir interface 112, or the like (e.g., 112A, 112B, etc.). In some embodiments, display devices 1018A and 1018B may be associated with separate fluid reservoirs (e.g., 114A, 114B, etc.).

In some embodiments, display devices 1018A and 1018B may each, at least partially, comprise a respective, or shared, user interface subsystem communicably connected to automated fluid dispenser 1000 via a wireless connection (e.g., Bluetooth®, etc.) that may be configured via one or more user interfaces (e.g., touch screen display 402, a user computing device, etc.). In some embodiments, display devices 1018A and 1018B may share user interface circuitry, sensory circuitry, or the like, at least partially, housed within housing body 102 of automated fluid dispenser 1000. In other embodiments, display devices 1018A and 1018B may be independent of automated fluid dispenser 1000. In such embodiments, power circuitry (e.g., a battery, etc.), interface circuitry (e.g., a processor, etc.), sensory circuitry (e.g., memory, thermistor, etc.), or the like, associated with display devices 1018A and 1018B may be configured within fluid reservoir 1014. For example, fluid reservoir 1014 may comprise a third fluid reservoir compartment (not shown) (e.g., a hollow base, a double-wall vacuum cavity, etc.) configured to house one or more components required for functional operations (e.g., temperature detection, graphical user interface element display, etc.) associated with display devices 1018A and 1018B.

FIGS. 11A, 11B, 11C, and 11D illustrate an example automated fluid dispenser 1100, according to some embodiments of the present disclosure.

Figure 11A:
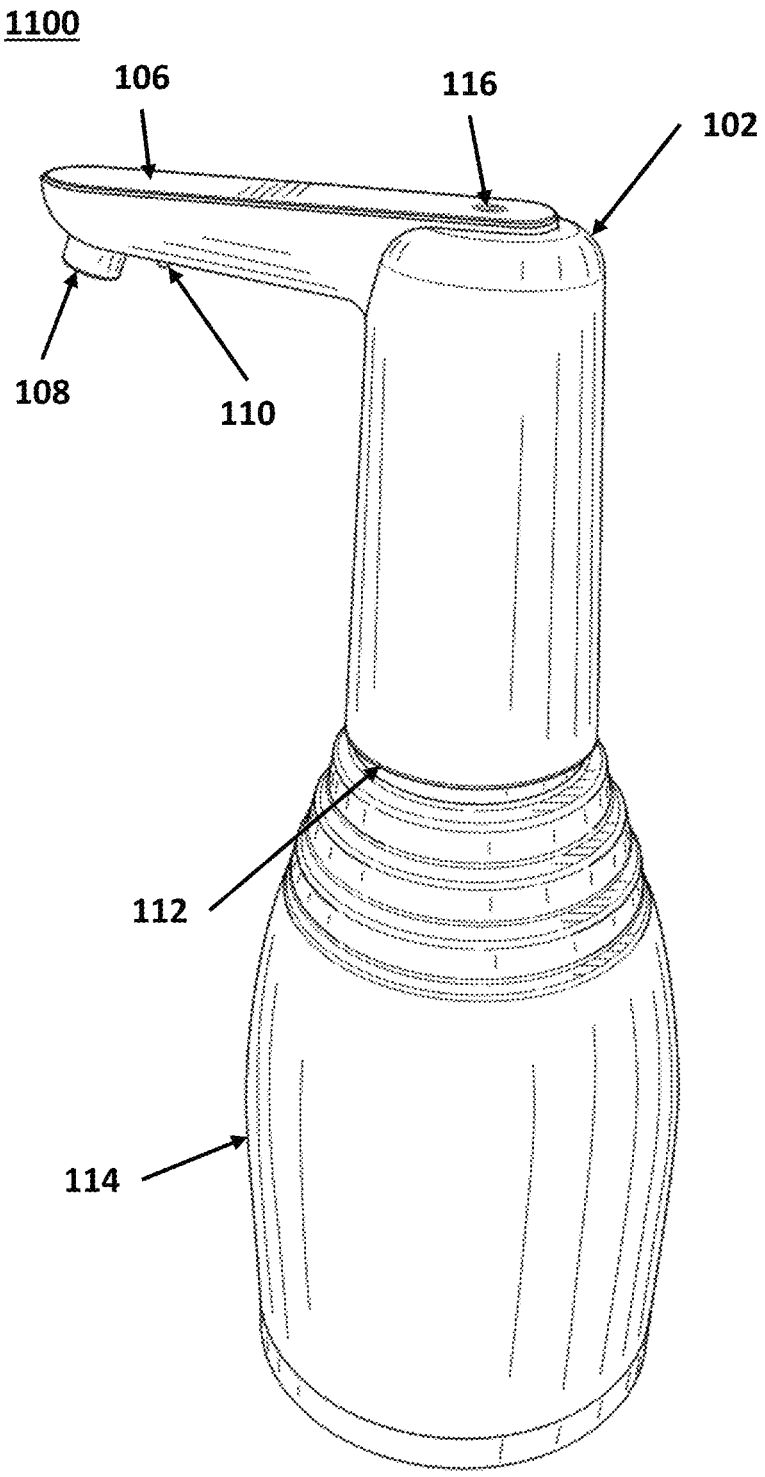

FIG. 11A illustrates a right-side perspective view of automated fluid dispenser 1100 comprising housing body 102, spout 106, nozzle 108, receptacle sensor 110, user interface element 116, fluid reservoir interface 112, and fluid reservoir 114. As illustrated, housing body 102 comprises, at least partially, spout 106 which is integrated therein. Housing body 102 and spout 106 as shown comprise a plastic material. Nozzle 108 as depicted is a metal material attached to the end of spout 106.

Figure 11B:
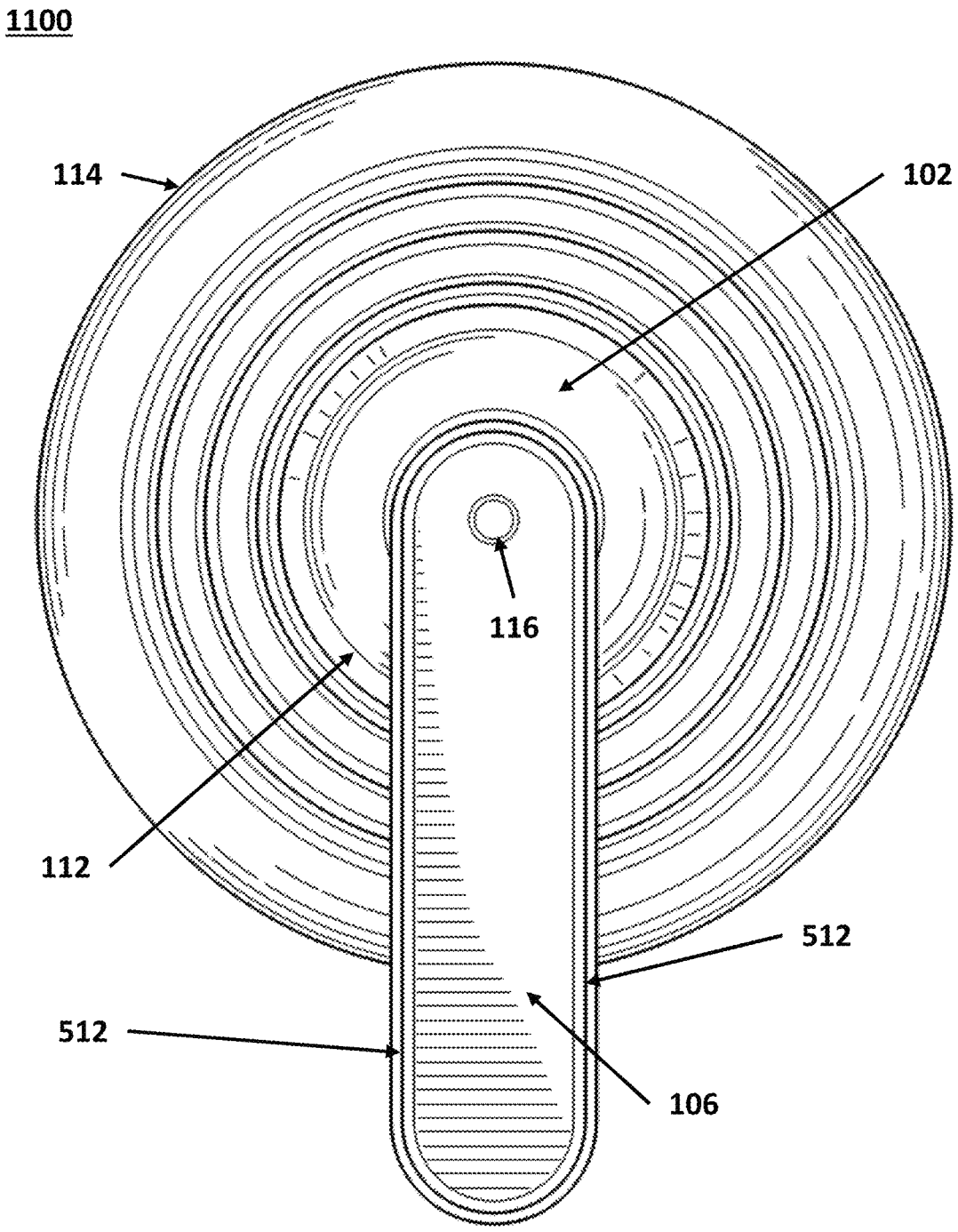

FIG. 11B illustrates a perspective top view of automated fluid dispenser 1100 comprising housing body 102, spout 106, user interface element 116, lighting user interface element 512, fluid reservoir interface 112, and fluid reservoir 114. As illustrated, lighting user interface element 512 of automated fluid dispenser 1100 is an LED strip embed in the integrated upper surface associated with housing body 102 and spout 106. As shown in FIG. 11B, a top surface associated with spout 106 and housing body 102 may, at least partially, comprise a translucent, transparent, and/or semi-transparent material (e.g., plastic, etc.). It will be appreciated, in light of the present disclosure, that a translucent, transparent, and/or semi-transparent material may be configured to more easily transmit light therethrough (e.g., light generated by lighting user interface element 512).

Figure 11C:
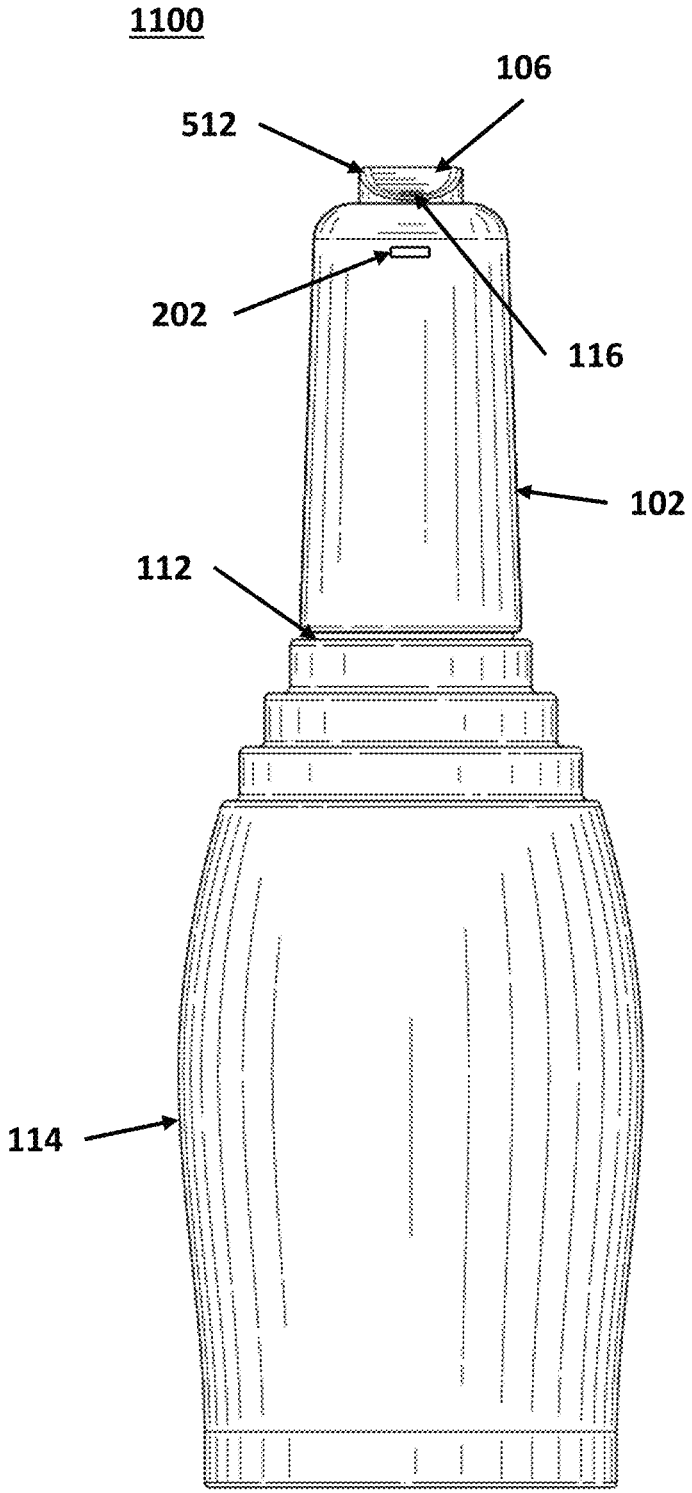

FIG. 11C illustrates a perspective rear view of automated fluid dispenser 1100. As illustrated in FIG. 11C, automated fluid dispenser 1100 further comprises a housing body opening 202. In some embodiments, housing body opening 202 may be configured for one or more of charging a battery, transferring data (e.g., updating firmware, etc.), releasing excess moisture buildup, or releasing excess pressure buildup. For example, housing body opening 202 may be configured to receive a USB-C for charging a lithium-ion battery at least partially contained in housing body 102. For example, housing body opening 202 may be configured to release pressure, and/or moisture, buildup within automated fluid dispenser 1100 or fluid reservoir 114 during pumping operations. In some embodiments, housing body opening 202 may be configured as an intake pipeline opening for pumping air into the fluid reservoir during pressurization pumping cycles.

Figure 11D:
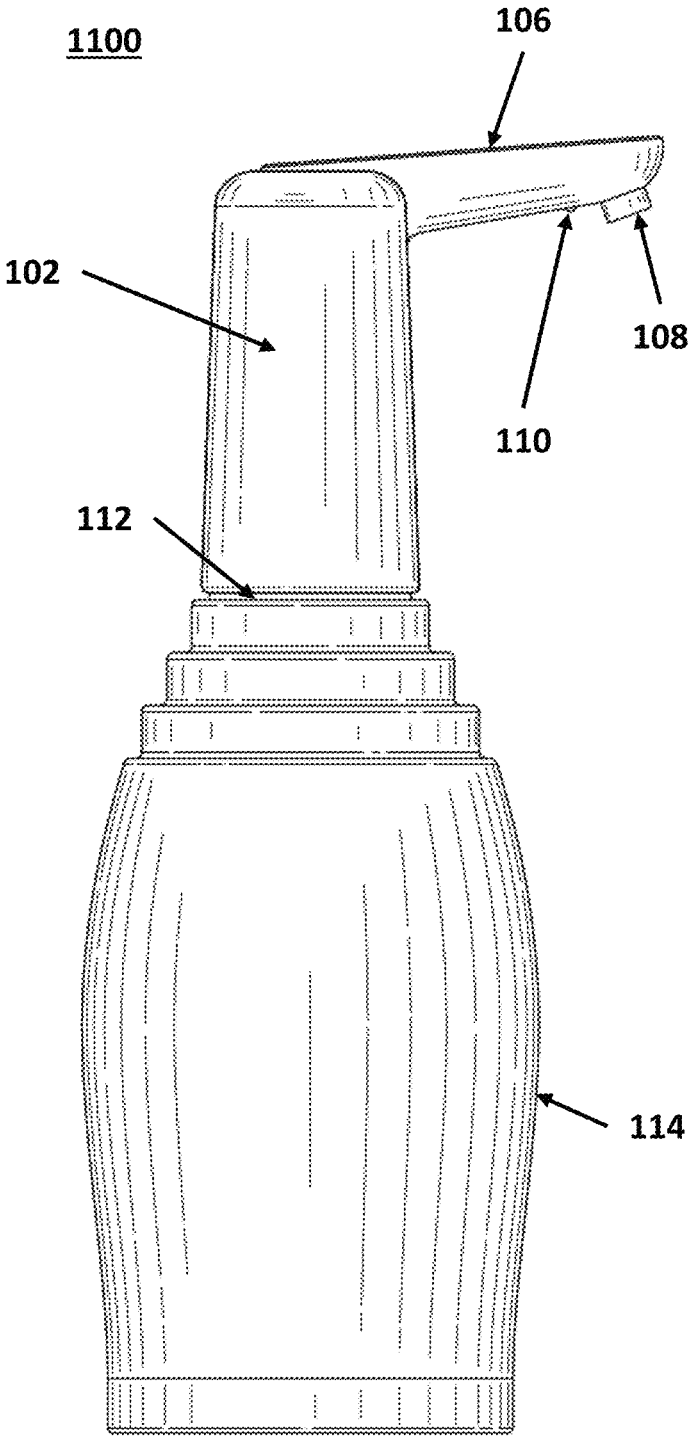

FIG. 11D illustrates a left-side perspective view of automated fluid dispenser 1100 comprising housing body 102, spout 106, nozzle 108, receptacle sensor 110, fluid reservoir interface 112, and fluid reservoir 114.

FIG. 12 is a flowchart of operations for dispensing a volume of fluid, with an example automated fluid dispenser, in response to detection of an example fluid receptacle, in accordance with example embodiments of the present disclosure. As shown in FIG. 12, exemplary dispensing process 1200 may be carried out by one or more example embodiments of an automated fluid dispenser system. For example, the operations described with respect to FIG. 12 may be performed by one or more embodiments illustrated by FIG. 1-10 or 11A-11D, or other embodiments of the present disclosure.

The process 1200 begins at operation 1202 when an example automated fluid dispenser (e.g., 100, 1000, 1100, etc.) is attached to a fluid reservoir via a fluid reservoir interface. At operation 1204, the automated fluid dispenser receives an activation signal via a user interface subsystem, the activation signal causing a power subsystem to at least supply electrical power to a pump and a receptacle sensor. At operation 1206, the automated fluid dispenser receives a receptacle sensor indication via the receptacle sensor, the receptacle sensor indication causes the pump to at least initiate a pump cycle. At operation 1208, the automated fluid dispenser pumps a volume of fluid via a pump subsystem comprising the pump and a pipeline, the pipeline configured to receive the volume of fluid from the fluid reservoir and convey the volume of fluid, via the pump, between a first opening of the pump subsystem and a second opening of the pump subsystem. At operation 1210, the automated fluid dispenser transfers the volume of fluid from the pump subsystem to a dispenser subsystem comprising a spout and a nozzle, the volume of fluid is received by the spout via the second opening of the pump subsystem and flows to the nozzle, the nozzle defines a fluid exit opening through which the volume of fluid exits the dispenser subsystem. At operation 1212, the automated fluid dispenser releases the volume of fluid via the nozzle.

An example embodiment of process 1200 executed by an example automated fluid dispenser (e.g., 100, 1000, 1100, etc.), as described by the present disclosure, can start by, for example, screwing the automated fluid dispenser to an insulated carafe containing coffee creamer. The automated fluid dispenser would interface with the carafe via complementary threaded surfaces (e.g., at a top opening of the carafe and the bottom surface of the automated fluid dispenser housing). In such embodiments, the automated fluid dispenser may be attached to the carafe by a user manually connecting the carafe by hand (e.g., a coffee shop employee). The user may then, once the two are attached, press a power button located on the housing, or a touch screen, of the automated fluid dispenser to turn-on one or more subsystem such as the sensory subsystem, pump subsystem, or the like. Additionally, in embodiments where the automated fluid dispenser is configured with a display screen, the display screen may display one or more graphical user interface elements to the user (e.g., a fill capacity, a time, etc.). With the automated fluid dispenser powered-on one or more users (e.g., coffee shop customers) may bring, for example, a coffee cup within range of a receptacle sensor and the receptacle sensor would transmit an indication signal to the pump subsystem to start pumping a volume of coffee creamer. The amount of coffee creamer dispensed to the coffee cup may be a preset amount (e.g., 1 ounce per indication signal) or the amount of coffee creamer may be dynamically adjusted by moving the coffee cup, for example, closer to the receptacle sensor.

FIG. 13 is a flowchart of operations for activating a pump cycle, of an example automated fluid dispenser, in response to receipt of an example activation signal, in accordance with example embodiments of the present disclosure. As shown in FIG. 13, exemplary activation process 1300 may be carried out by one or more example embodiments of an automated fluid dispenser system. For example, the operations described with respect to FIG. 13 may be performed by one or more embodiments illustrated by FIG. 1-10 or 11A-11D, or other embodiments of the present disclosure.

The process 1300 begins at operation 1302 when an example automated fluid dispenser (e.g., 100, 1000, 1100, etc.), comprising at least one processor and at least one memory (e.g., a non-transitory computer readable storage medium comprising computer program code instructions), receives an activation signal via a user interface subsystem comprising a touch screen display, the activation signal causing a power subsystem to at least supply electrical power to a pump and a receptacle sensor. At operation 1304, the example automated fluid dispenser receives a receptacle sensor indication via the receptacle sensor, the receptacle sensor indication causes the pump to at least initiate a pump cycle defining at least a cycle runtime that is proportional to one or more receptacle sensor indication attributes. At operation 1306, the example automated fluid dispenser displays, via the touch screen display, one or more graphical user interface elements defining at least a time of day, a fluid reservoir capacity level, an internal fluid reservoir temperature, a power subsystem capacity level, and/or a fluid name. At operation 1308, the example automated fluid dispenser dynamically displays, via the touch screen display, in response to at least the receptacle sensor indication, a volume of fluid defined by the pump cycle.

An example embodiment of process 1300 executed by an example automated fluid dispenser (e.g., 100, 1000, 1100, etc.), as described by the present disclosure, can be performed, at least partially, in conjunction with some embodiments of process 1200. For example, an automated fluid dispenser configured with touch screen display may be interfaced with the insulated carafe containing coffee creamer as described with respect to process 1200. A user may then power-on the automated fluid dispenser by pressing on a graphical user interface element associated with the power subsystem functionality. In some embodiments, the automated fluid dispenser may be in a stand-by, or sleep, mode and power may be supplied to the user interface in a reduced capacity to allow for the display of, and user interaction with, a power button rendered in the form of a graphical user interface element via the touch screen display. Once the user turns on the automated fluid dispenser, power (e.g., electrical current or voltage) may be transferred to one or more subsystems. For example, the pump subsystem may be turned-on and configured to start to buildup pressure in preparation of a pump cycle signal and power may be supplied to the user interface subsystem at an increased rate (e.g., increased current and/or voltage) to facilitate additional functionality (e.g., display of additional graphical user interface elements). Power may, also, be supplied to the sensory subsystem (e.g., receptacle sensor, fill sensor, temperature sensor, etc.).

With the automated fluid dispenser powered-on one or more users may bring, for example, a coffee cup within range of a receptacle sensor and the receptacle sensor can transmit an indication signal to the pump subsystem to start pumping a volume of coffee creamer. In response to the volume of coffee creamer being removed from the carafe the sensory subsystem can dynamically generate one or more sensory signals associated with one or more sensors. For example, upon detection of a pumping cycle the sensory circuitry may be configured to detect the amount of coffee creamer remaining in the carafe. Moreover, the sensory circuitry may be configured to detect the internal temperature of the carafe and compare that temperature to a threshold value. Once the sensory circuitry has made a determination associated with one or more sensors, the sensory circuitry may transmit one or more indication signals to the user interface subsystem. For example, the sensory circuitry may be configured to indicate to the user interface subsystem that the carafe is 75% full after dispensing the volume of coffee creamer and, in response, the user interface subsystem can configure the touch screen display, via one or more graphical user interface elements, to render, at least, this information to a user.

Moreover, upon receipt of the receptacle sensor indication the user interface subsystem may display the quantity to be dispensed. For example, if the receptacle sensor indication defines the amount of fluid to be dispensed as 1 ounce then the touch screen display can render one or more graphical user interface elements to notify the user that 1 ounce will be dispensed. The amount displayed (e.g., 1 ounce) may change as a user repositions their coffee cup relative to the receptacle sensor. For example, if the coffee cup is approximately 1 inch, 2 inches, or 3 inches from the sensor then the quantity to be dispensed may be 1 ounce, 2 ounces, or 3 ounces respectively and the user interface may render this information in real-time as the user repositions their coffee cup. The user may select, or lock-in, the quantity to be dispensed by providing a secondary indication (e.g., holding the coffee cup in approximately one position for a predefined period of time, such as, for 3 seconds). In some embodiments, the secondary indication may be received via the touch screen display, or the like (e.g., a physical switch, button, motion sensor, etc.).

In some embodiments, a first pump subsystem and a second pump subsystem may converge to, or at least partially utilize, a single dispenser subsystem. In such embodiments, the first pump subsystem and the second pump subsystem may each be associated with a different fluid and may alternate pump cycle operations (e.g., the first pump subsystem stops pumping before the second pump subsystem initiates pumping). In other embodiments, the first pump subsystem and the second pump subsystem may each pump one ingredient for a single dispensable beverage. For example the first pump subsystem may pump filtered water and the second pump subsystem may pump juice concentrate. In such embodiments, the dispenser subsystem, or components thereof (e.g., spout 106, nozzle 108, etc.) may be, at least partially, a mixing chamber configured to mix the plurality of fluids. In such embodiments, the first pump subsystem and the second pump subsystem may be configured to pump proportionally to each other. For example, the first pump subsystem may be configured to pump 7 ounces of a first fluid (e.g., water, etc.) and, in response, the second pump subsystem may be configured to pump 1 ounce of a second fluid (e.g., juice concentrate, partially dehydrated milk, etc.).

In some embodiments, user interface element 116 may be configured at least partially within receptacle sensor 110. For example, embodiments of the automated fluid dispenser (e.g., 200, 900, etc.) may be configured to automatically turn-off, or at least partially go into a standby mode, sleep mode, or the like, after a predefined period of time has elapsed (e.g., after 5 minutes without receiving a user interaction signal) and the automated fluid dispenser (e.g., 200, 900, etc.) may be further configured to turn-on, in response, to a input signal detected by receptacle sensor 110 (e.g., the presence of a fluid receptacle 604, or the like, within a range of receptacle sensor detection signal 602). Additionally, the automated fluid dispenser (e.g., 200, 900, etc.) may be further configured to initiate a pump cycle upon receipt of at least a second input signal detected by receptacle sensor 110. In some embodiments, a single input signal detected by receptacle sensor 110 may turn-on the automated fluid dispenser (e.g., 200, 900, etc.) and, additionally, start the pump cycle operations. In some embodiments, the automated fluid dispenser (e.g., 200, 900, etc.) may internally initiate (e.g., by at least one processor) a countdown timer (e.g., set for 5 minutes) after completion of each pump cycle to determine when to automatically turn-off, or at least partially enter a standby mode, sleep mode, or the like. In some embodiments, automated fluid dispenser (e.g., 200, 900, etc.) may dynamically re-start, or reset, the countdown timer in an instance another input signal is detected by receptacle sensor 110.

While some embodiments described herein relate to food and beverage containers (e.g., milk gallons, juice cartons, carafes, water bottles, etc.), and other particular containers, one of ordinary skill in the art will appreciate that the teachings herein may also apply to a wide range of additional containment, storage, dispenser, and transportation applications. Some such additional applications include chemical handling (e.g., dispensing oil for automotive applications, hand sanitizers, automated pesticide distribution for plants, etc.), mining (e.g., pumping water, pumping oil, etc.), water removal (e.g., a flooded basement, well water retrieval, etc.), medical applications (e.g., stomach pumps, etc.), animal husbandry (e.g., automated feed dispensers, automated milk dispensers for animals abandoned by their mothers, etc.), air freshener diffusers/dispensers, the like, or combinations thereof.

The embodiments described herein may be scalable to accommodate at least the aforementioned applications. Various components of embodiments described herein can be added, removed, modified, and/or duplicated as one skilled in the art would find convenient and/or necessary to implement a particular application in conjunction with the teachings of the present disclosure. In some embodiments, specialized features, characteristics, materials, components, and/or equipment may be applied in conjunction with the teachings of the present disclosure as one skilled in the art would find convenient and/or necessary to implement a particular application.

Moreover, many modifications and other embodiments of the present disclosure set forth herein will come to mind to one skilled in the art to which this disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the appended claims. In this regard, for example, different combinations of elements and/or functions than those explicitly described above are also contemplated as can be set forth in some of the appended claims. Although specific terms are employed herein, they are used in a generic and descriptive sense only and not for purposes of limitation.

That which is claimed is:

1. An automated fluid dispenser, comprising:

a housing comprising one or more materials, the housing defines a body comprising a top surface, a sidewall, and a bottom surface, the housing is configured to attach to a fluid reservoir via a fluid reservoir interface;

a pump subsystem that is at least partially enclosed by the housing, the pump subsystem comprises a pump and a pipeline, the pipeline configured to receive a fluid from the fluid reservoir and convey the fluid via the pump between a first opening of the pump subsystem and a second opening of the pump subsystem;

a dispenser subsystem that is at least partially enclosed by the housing and extends from one or more of the top surface or the sidewall of the body, the dispenser subsystem comprises a spout and a nozzle, the spout is attached to the body at a first end of the spout and to the nozzle at a second end of the spout, the spout is configured to receive the fluid from the pump subsystem and convey the fluid to the nozzle, the nozzle defines a fluid exit opening through which the fluid exits the dispenser subsystem; and a receptacle sensor that is at least partially enclosed by the housing, the receptacle sensor is configured to detect, within a predefined distance, a distance between the receptacle sensor and a fluid receptacle that is within the predefined distance and transmit a signal, to at least the pump subsystem, causing the pump subsystem to pump a volume of fluid, wherein the volume of fluid is proportional to a detected distance between the receptacle sensor and the fluid receptacle.

2. The automated fluid dispenser according to claim 1, wherein the volume of fluid is proportional to a period of time that the fluid receptacle is detected by the receptacle sensor.

3. The automated fluid dispenser according to claim 1, wherein the receptacle sensor is configured to detect a first distance between the receptacle sensor and the fluid receptacle and cause the pump subsystem to pump a first volume of fluid, wherein the receptacle sensor is configured to detect a second distance between the receptacle sensor and the fluid receptacle and cause the pump subsystem to pump a second volume of fluid, and wherein the receptacle sensor is configured to detect a plurality of third distances between the receptacle sensor and the fluid receptacle and cause the pump subsystem to pump a respective volume of fluid associated with each of the plurality of third distances.

4. The automated fluid dispenser according to claim 1, further comprising a user interface subsystem, the user interface subsystem comprises one or more user interface elements, the user interface elements comprise one or more of a push button, a toggle button, a switch, a slider switch, a light sensor, a motion sensor, a pressure sensor, a light emitting diode, a microphone, or a speaker.

5. The automated fluid dispenser according to claim 4, wherein the user interface subsystem comprises a touch screen display and one or more graphical user interface elements.

6. The automated fluid dispenser according to claim 5, wherein the touch screen display is configured to render one or more of a maximum capacity, a fluid level, an alphanumeric character, a power level, a date, a time of day, a countdown timer, or a temperature.

7. The automated fluid dispenser according to claim 1, further comprising a power subsystem that is at least partially enclosed by the housing, the power subsystem comprises one or more of a power regulation circuit, a battery, an electrical outlet interface, a universal serial bus interface, a charging circuit, or a photovoltaic cell.

8. The automated fluid dispenser according to claim 1, wherein the housing comprises a handle extending from one or more surfaces defined by the housing.

9. The automated fluid dispenser according to claim 1, wherein the pump is one or more of a dynamic pump, positive displacement pump, centrifugal pump, rotary pump, reciprocating pump, internal/external gear pump, slide/rotary vane pump, piston pump, plunger pump, screw pump, or diaphragm pump.

10. The automated fluid dispenser according to claim 1, wherein the pipeline is one or more of a pipe, a tube, or a hose, and comprises one or more of a rigid or flexible metal, plastic, fabric, composite, ceramic, or glass material.

11. The automated fluid dispenser according to claim 1, wherein the pipeline comprises a flexible hose that is attached, at a first end of the flexible hose, to the bottom surface of the housing by way of a hose nipple and is attached, at a second end of the flexible hose, to a frustum sinker, the frustum sinker defines a pipeline intake opening that extends from a first surface of the frustum sinker to a second surface of the frustum sinker.

12. The automated fluid dispenser according to claim 1, wherein the receptacle sensor comprises one or more of a light emitting diode, a motion sensor, a proximity sensor, a pressure sensor, a camera, or a limit switch.

13. The automated fluid dispenser according to claim 1, wherein the housing comprises one or more of a housing opening, the housing opening is configured to receive a battery, receive a universal serial bus cable, release pressure from the pump subsystem, or release pressure from the fluid reservoir.

14. The automated fluid dispenser according to claim 13, wherein the housing opening is defined by a pressure release valve and the housing opening is at least partially covered by a filter, mesh, or screen.

15. The automated fluid dispenser according to claim 1, wherein the fluid reservoir interface is defined by one or more first threaded surfaces of the housing configured to interlock with one or more second threaded surfaces of the fluid reservoir.

16. The automated fluid dispenser according to claim 1, wherein the fluid reservoir interface is defined by one or more seals, and at least the one or more seals are configured to maintain a negative pressure environment within the fluid reservoir.

17. The automated fluid dispenser according to claim 1, wherein the fluid reservoir is a plurality of fluid reservoirs, and wherein the fluid reservoir is thermally insulated.

18. The automated fluid dispenser according to claim 1, wherein the housing is configured to removably attach to the fluid reservoir via the fluid reservoir interface.

19. The automated fluid dispenser according to claim 1, wherein the housing is configured to permanently attach to the fluid reservoir via the fluid reservoir interface.

20. The automated fluid dispenser according to claim 1, wherein the housing is configured with an integrated fluid reservoir, wherein the integrated fluid reservoir comprises at least a portion of the housing, and wherein the fluid reservoir interface comprises a seamless transition between the sidewall of the housing and the sidewall of the fluid reservoir.

21. An automated fluid dispenser, comprising:

a housing comprising one or more materials, the housing defines a body comprising a top surface, a sidewall, and a bottom surface, the housing is configured to attach to a fluid reservoir via a fluid reservoir interface;

a pump subsystem that is at least partially enclosed by the housing, the pump subsystem comprises a pump and a pipeline, the pipeline configured to receive a fluid from the fluid reservoir and convey the fluid via the pump between a first opening of the pump subsystem and a second opening of the pump subsystem;

a dispenser subsystem that is at least partially enclosed by the housing and extends from one or more of the top surface or the sidewall of the body, the dispenser subsystem comprises a spout and a nozzle, the spout is attached to the body at a first end of the spout and to the nozzle at a second end of the spout, the spout is configured to receive the fluid from the pump subsystem and convey the fluid to the nozzle, the nozzle defines a fluid exit opening through which the fluid exits the dispenser subsystem; and a receptacle sensor that is at least partially enclosed by the housing, the receptacle sensor is configured to detect, within a predefined distance, a distance between the receptacle sensor and a fluid receptacle that is within the predefined distance and transmit a signal, to at least the pump subsystem, causing the pump subsystem to pump a volume of fluid wherein the receptacle sensor is configured to detect a first distance between the receptacle sensor and the fluid receptacle and cause the pump subsystem to pump a first volume of fluid, wherein the receptacle sensor is configured to detect a second distance between the receptacle sensor and the fluid receptacle and cause the pump subsystem to pump a second volume of fluid, and wherein the receptacle sensor is configured to detect a plurality of third distances between the receptacle sensor and the fluid receptacle and cause the pump subsystem to pump a respective volume of fluid associated with each of the plurality of third distances.

22. An automated fluid dispenser, comprising:

a housing comprising one or more materials, the housing defines a body comprising a top surface, a sidewall, and a bottom surface, the housing is configured to attach to a fluid reservoir via a fluid reservoir interface wherein the housing comprises at least one housing opening, the at least one housing opening is configured to receive a battery, receive a universal serial bus cable, release pressure from the pump subsystem, or release pressure from the fluid reservoir, wherein the at least one housing opening is defined by a pressure release valve and the at least one housing opening is at least partially covered by a filter, mesh, or screen;

a pump subsystem that is at least partially enclosed by the housing, the pump subsystem comprises a pump and a pipeline, the pipeline configured to receive a fluid from the fluid reservoir and convey the fluid via the pump between a first opening of the pump subsystem and a second opening of the pump subsystem;

a dispenser subsystem that is at least partially enclosed by the housing and extends from one or more of the top surface or the sidewall of the body, the dispenser subsystem comprises a spout and a nozzle, the spout is attached to the body at a first end of the spout and to the nozzle at a second end of the spout, the spout is configured to receive the fluid from the pump subsystem and convey the fluid to the nozzle, the nozzle defines a fluid exit opening through which the fluid exits the dispenser subsystem; and a receptacle sensor that is at least partially enclosed by the housing, the receptacle sensor is configured to detect, within a predefined distance, a distance between the receptacle sensor and a fluid receptacle that is within the predefined distance and transmit a signal, to at least the pump subsystem, causing the pump subsystem to pump a volume of fluid.

* * * * *